US011230950B1

(12) United States Patent
McCloy et al.

(10) Patent No.: US 11,230,950 B1
(45) Date of Patent: Jan. 25, 2022

(54) ELECTRICALLY-ACTUATED VARIABLE CAMSHAFT TIMING PHASER WITH REMOVABLE FIXTURE

(71) Applicant: BorgWarner Inc., Auburn Hills, MI (US)

(72) Inventors: Chad McCloy, Cortland, NY (US); Mark Wigsten, Lansing, NY (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 17/155,612

(22) Filed: Jan. 22, 2021

(51) Int. Cl.
*F01L 1/352* (2006.01)
*F01L 1/46* (2006.01)
*F01L 13/00* (2006.01)

(52) U.S. Cl.
CPC ..... *F01L 1/352* (2013.01); *F01L 1/46* (2013.01); *F01L 2013/103* (2013.01); *F01L 2303/02* (2020.05); *F01L 2820/032* (2013.01)

(58) Field of Classification Search
CPC ..... F01L 1/352; F01L 1/46; F01L 2013/103; F01L 2303/02; F01L 2820/032
USPC ..... 123/90.17
See application file for complete search history.

(56) References Cited

U.S. PATENT DOCUMENTS

| | | | | |
|---|---|---|---|---|
| 5,588,404 | A * | 12/1996 | Lichti | F01L 1/34406 123/90.17 |
| 6,276,321 | B1 | 8/2001 | Lichti et al. | |
| 8,516,982 | B2 * | 8/2013 | David | F01L 1/352 123/90.17 |
| 9,470,119 | B2 | 10/2016 | Shum et al. | |
| 9,856,761 | B2 * | 1/2018 | Iwasaki | F01L 1/352 |
| 10,107,154 | B2 | 10/2018 | Pluta et al. | |
| 2019/0048764 | A1 | 2/2019 | Gallon et al. | |

FOREIGN PATENT DOCUMENTS

EP 2006499 A2 12/2008

* cited by examiner

*Primary Examiner* — Jorge L Leon, Jr.
(74) *Attorney, Agent, or Firm* — Reising Ethington P.C.

(57) ABSTRACT

An electrically-actuated variable camshaft timing (VCT) phaser is employed for use with an internal combustion engine (ICE). The electrically-actuated VCT phaser includes a gear set assembly and a fixture. The gear set assembly has an input gear and an output gear, among other possible components. The input gear receives rotational drive input from an engine crankshaft, and the output gear transmits rotational drive output to an engine camshaft. The fixture is secured in the gear set assembly. Amid installation of the electrically-actuated VCT phaser on the ICE, the fixture constrains rotational movement of the gear set assembly. After installation, the fixture can be removed from the gear set assembly.

14 Claims, 13 Drawing Sheets

ELECTRICALLY-ACTUATED VARIABLE CAMSHAFT TIMING PHASER WITH REMOVABLE FIXTURE

TECHNICAL FIELD

The present application relates to variable camshaft timing (VCT) phasers employed for use with internal combustion engines (ICEs) and, more particularly, to electrically-actuated VCT phasers.

BACKGROUND

Automotive internal combustion engines often have a crankshaft and one or more camshafts that are fixed at angular positions relative to each other. The angular relationship between the crankshaft and the camshaft(s) carefully controls the opening and closing of valves to regulate combustion relative to a linear position of a reciprocating piston. Increasingly, variable camshaft timing (VCT) phasers can be used with one or more camshafts to vary the angular position of the camshaft(s) relative to the angular position of the crankshaft. The VCT phasers can advance or retard the angular position of the camshaft(s) relative to the crankshaft to improve the operation of the ICE using hydraulically- or electrically-actuated mechanisms. The mechanisms can have an input that receives rotational force from the crankshaft, and an output that is angularly displaced relative to the input by the mechanism and that transmits rotational force to the camshaft(s).

During assembly of the ICE, it is important to establish and maintain the precise angular position of the crankshaft and the camshaft(s) leading up to linking of these elements via an endless loop, such as a chain or a belt. Once the endless loop is engaged with the crankshaft and camshaft(s) and tensioned, the relative position of the crankshaft and camshaft(s) is maintained. With respect to electrically-actuated VCT phasers, the relative position of the input to the output is not always known. So, maintaining the precise relationship between all of the electrically-actuated VCT phaser, camshaft(s), and crankshaft can be challenging. Also, assembly of the electrically-actuated VCT phaser to the camshaft can involve applying torque to a center bolt that may in turn transmit the applied torque through the gearbox of the VCT phaser.

SUMMARY

In one implementation, an electrically-actuated variable camshaft timing (VCT) phaser may include a gear set assembly and a fixture. The gear set assembly has an input gear and an output gear. The input gear receives rotational drive input from an engine crankshaft when the electrically-actuated VCT phaser is installed with an internal combustion engine. The output gear transmits rotational drive output to an engine camshaft in installation. The fixture is secured in the gear set assembly, and can be removed therefrom. The fixture constrains rotational movement of the gear set assembly amid installation of the electrically-actuated VCT phaser on the internal combustion engine. The fixture lacks direct securement between the input gear and the output gear.

In another implementation, an electrically-actuated variable camshaft timing (VCT) phaser may include a planetary gear set and a pin. The planetary gear set includes a carrier plate and a housing assembly, among other possible components. The carrier plate has a first opening and the housing assembly has a second opening. The pin is received in the first opening of the carrier plate and is received in the second opening of the housing assembly. The pin can be removed from both the first opening and the second opening. The pin constrains rotational movement of the planetary gear set amid installation of the electrically-actuated VCT phaser on an internal combustion engine.

DETAILED DESCRIPTION

Multiple embodiments of an electrically-actuated variable camshaft timing (VCT) phaser with a removable fixture are presented in the figures and described herein. The removable fixture can be temporarily secured in the VCT phaser before and during installation of the VCT phaser on an internal combustion engine of an automobile. The VCT phaser can be shipped with the fixture secured in place. The fixture serves to constrain rotational movement of a gear set assembly of the VCT phaser, and to fix movement between an input and output gear. The gear set assembly is rendered immobile with the fixture's securement. A known angular position of the input gear with respect to a known angular position of the output gear is hence maintained via the fixture. In keyless timing applications where the engine's camshaft lacks measures for locating the VCT phaser relative to the camshaft for installation purposes, maintaining the angular positions ensures intended and appropriate timing functionality of the VCT phaser at the time of installing the VCT phaser on the internal combustion engine and its use thereafter. Furthermore, the fixture establishes a load path through the gear set assembly of the VCT phaser whereby the VCT phaser can more readily bear torque loads exerted during installation and when a center bolt is tightened down. As used in this description, the terms axially, radially, circumferentially, angularly, and their related forms are with reference to the generally circular and annular and cylindrical components of the VCT phaser, unless otherwise indicated.

Figure 1:
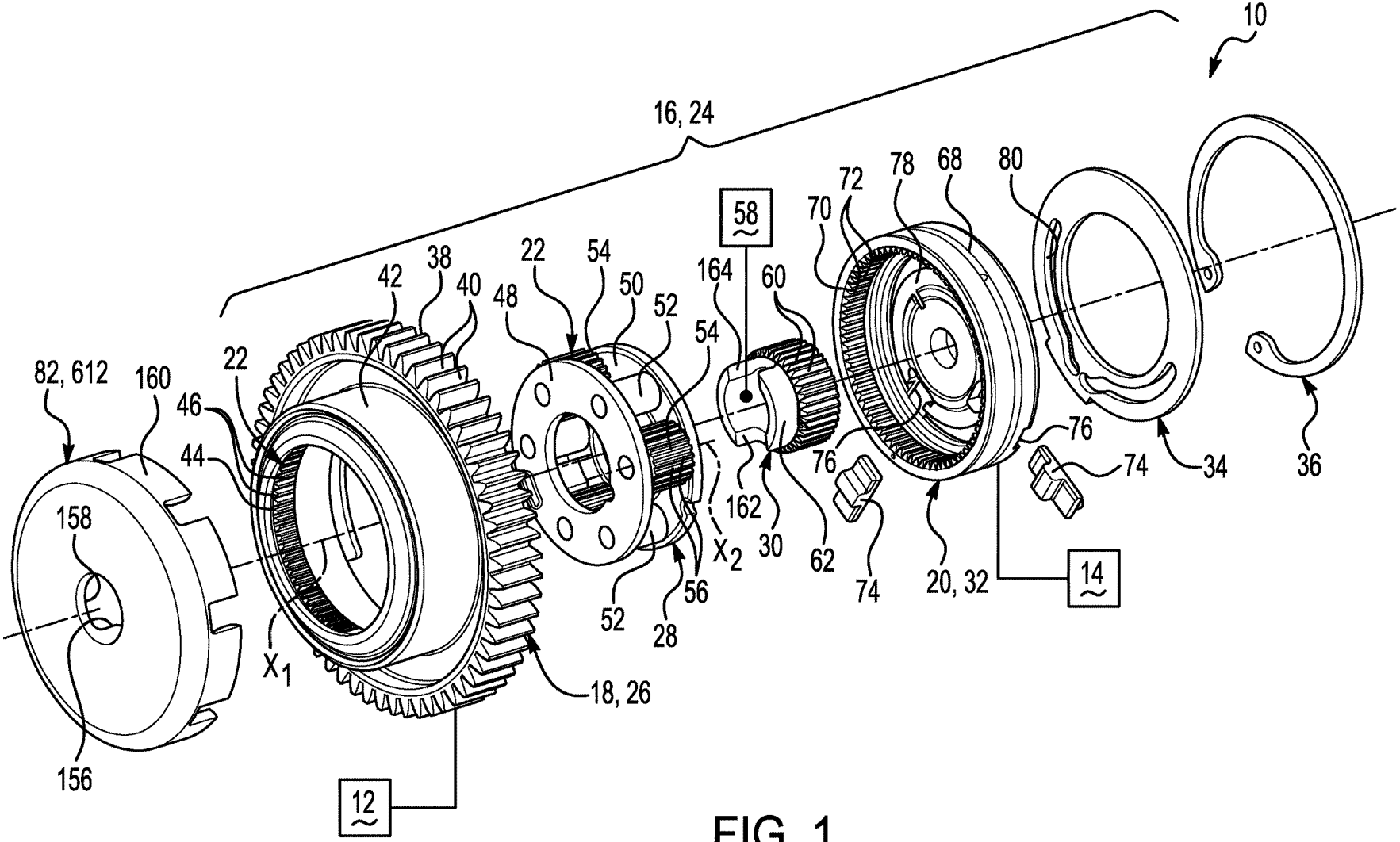
FIG. 1 is an exploded view of an embodiment of an electrically-actuated variable camshaft timing (VCT) phaser and a fixture.

An embodiment of an electrically-actuated variable camshaft timing (VCT) phaser 10 is shown in an exploded view in FIG. 1. The VCT phaser 10 is a multi-piece mechanism with components that work together to transfer rotation from a crankshaft 12 and to a camshaft 14 of the internal combustion engine, and that can work together to angularly displace the camshaft 14 relative to the crankshaft 12 for advancing and retarding engine valve opening and closing. The VCT phaser 10 can have different designs and constructions and components in different embodiments depending upon, among other possible factors, the application in which the phaser is employed and the crankshaft and camshaft that it works with.

In the embodiment presented in the figures, for example, and with particular reference to FIG. 1, the VCT phaser 10 has a gear set assembly 16 that transmits rotational movement through the VCT phaser 10. In general, the gear set assembly 16 includes an input gear 18 and an output gear 20. The input gear 18 receives rotational drive input from the crankshaft 12, and the output gear 20 transmits rotational drive output to the camshaft 14. One or more intermediate gears 22 are situated in a path of rotational transmission between the input gear 18 and the output gear 20. The intermediate gear(s) 22 reside downstream of the input gear 18 and reside upstream of the output gear 20. The gear set assembly 16 can have various gearbox arrangements and types in different embodiments. In the embodiments depicted in FIGS. 1-21, for instance, the gear set assembly 16 has a gearbox arrangement of the planetary gearbox type, but could be of the harmonic drive gearbox type, eccentric gearbox type, cycloidal gearbox type, or another gearbox type.

Figure 2:
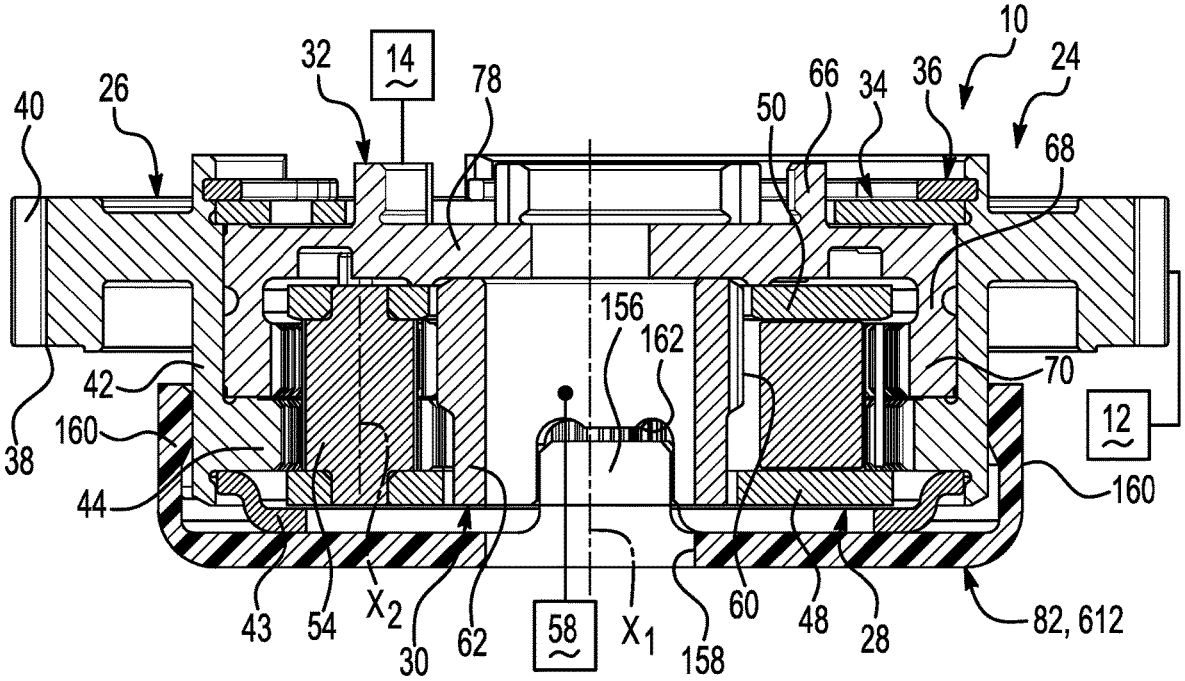
FIG. 2 is a sectional view of the electrically-actuated VCT phaser and fixture.
Figure 3:
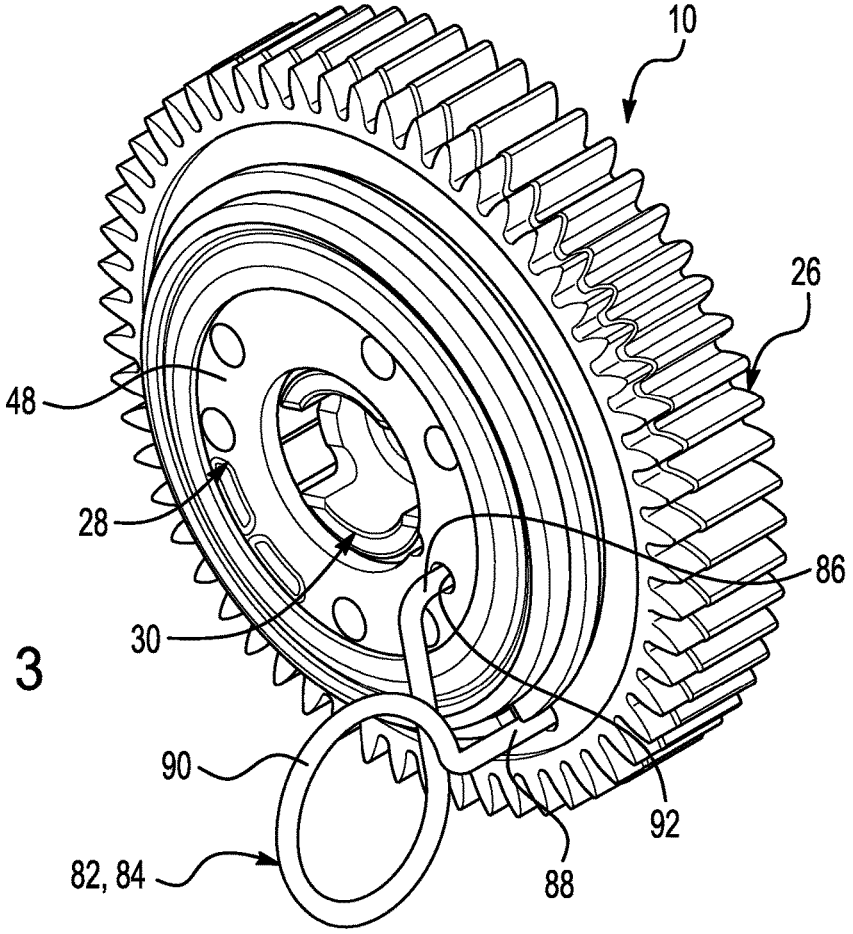
FIG. 3 is a perspective view of another embodiment of the electrically-actuated VCT phaser and fixture.

With reference to FIGS. 1 and 2, a planetary gear set 24 according to an embodiment includes a housing assembly 26, a carrier assembly 28, a sun gear 30, an inner plate 32, a plate 34, and a rotorclip 36. The housing assembly 26 receives rotational drive input from the crankshaft 12 and rotates about an axis $X_1$, and hence serves as the input gear 18 in these embodiments. A timing chain or a timing belt is looped around a sprocket 38 and also around the crankshaft 12 so that rotation of the crankshaft 12 translates into rotation of the housing assembly 26 via the timing chain or belt. Still, other techniques for transferring rotation between the housing assembly 26 and the crankshaft 12 are possible. At an exterior, the sprocket 38 has a set of teeth 40 for mating with the timing chain or belt. A wall 42 extends axially and, in assembly, surrounds other components of the planetary gear set 24. An outer retaining plate 43 can be connected to the wall 42 via roll-forming or another connection technique, such that the two structures move and rotate in unison. At an interior, the housing assembly 26 has a first ring gear 44. The first ring gear 44 is a unitary extension of the wall 42, constituting a monolithic construction. But the first ring gear 44 could be connected to the wall 42 via a cutout and tab interconnection, bolting, or some other way. The first ring gear 44 receives rotational drive input from the sprocket 38 so that the first ring gear 44 and sprocket 38 rotate together about the axis $X_1$ in operation. The first ring gear 44 engages with planet gears (described below) of the carrier assembly 28 and has a set of teeth 46 at its interior for teeth-to-teeth meshing with the planet gears. The teeth 46 project radially-inwardly relative to the annular shape of the first ring gear 44.

The carrier assembly 28 resides intermediate the housing assembly 26 and the inner plate 32 in terms of a path of rotational transmission therebetween. The carrier assembly 28 includes a first carrier plate 48 and a second carrier plate 50. The first carrier plate 48 is located at an axially outboard end relative to the camshaft 14 when installed on the internal combustion engine, and the second carrier plate 50 is located opposite the first carrier plate 48 at an axially inboard end relative to the camshaft 14. Cylinders 52 link the first and second carrier plate 48, 50 together for making a connection between them. Multiple planet gears 54 are carried by the first and second carrier plates 48, 50. The planet gears 54 rotate about their individual rotational axes $X_2$ when the VCT phaser 10 is in the midst of bringing the camshaft 14 to and from the advanced and retarded angular positions. When not advancing or retarding, the planet gears 54 revolve together around the axis $X_1$ with the housing assembly 26, the sun gear 30, and the inner plate 32. In FIGS. 1 and 2, there are a total of three discrete planet gears 54 that are similarly designed and constructed with respect to one another, but there could be other quantities of planet gears. The planet gears 54 engage with the first ring gear 44 and a second ring gear (described below) of the inner plate 32, and each planet gear 54 has a set of teeth 56 at its exterior for teeth-to-teeth meshing with the first and second ring gears.

Still referring to FIGS. 1 and 2, the sun gear 30 is connected to an electric motor 58 and is driven by the electric motor 58 for rotation about the axis $X_1$. The connection between the sun gear 30 and the electric motor 58 can be made in a way that transmits rotation from the electric motor 58 to the sun gear 30. A pin and slot interconnection is an example of such a connection. The sun gear 30 engages with the planet gears 54 and has a set of teeth 60 at its exterior for teeth-to-teeth meshing with the planet gears 54. A cylindrical wall 62 spans from the set of teeth 60 for interconnecting with the electric motor 58.

The inner plate 32 transmits rotational drive output to the camshaft 14 and rotates about the axis $X_1$. By way of a connection to the camshaft 14, the inner plate 32 drives rotation of the camshaft 14 about the axis $X_1$. The connection can be made in different ways, including by way of a center bolt 64 (depicted, for example, in FIG. 4). A sleeve 66 projects axially in the direction of the camshaft 14 and can guide connection with the camshaft 14. A cylindrical wall 68 projects axially in the opposite direction of the sleeve 66. At an interior, the inner plate 32 has a second ring gear 70. The second ring gear 70 axially neighbors the first ring gear 44 and, together, the two ring gears 44, 70 constitute a split ring gear construction for the VCT phaser 10. Still, the arrangement of the planetary gearbox type can vary in other embodiments and need not have the split ring gear construction depicted and described here. The second ring gear 70 is a unitary extension of the inner plate 32 and particularly of the cylindrical wall 68, constituting a monolithic construction. But the second ring gear 70 could be connected to the cylindrical wall 68 via a cutout and tab interconnection, bolting, or some other way. Due to the construction, the second ring gear 70 and inner plate 32 rotate together about the axis $X_1$ in operation. The second ring gear 70 engages with the planet gears 54 and has a set of teeth 72 at its interior for teeth-to-teeth meshing with the planet gears 54. The teeth 72 project radially-inwardly relative to the annular shape of the second ring gear 70. With respect to each other, the number of teeth between the first and second ring gears 44, 70 can differ by a multiple of the number of planet gears 54 provided. For example, the teeth 46 of the first ring gear 44 could count eighty individual teeth, while the teeth 72 could count seventy-seven individual teeth—a difference of three individual teeth for the three planet gears 54 in this example. Satisfying this relationship furnishes the advancing and retarding capabilities by imparting relative rotational movement and relative rotational speed between the first and second ring gears 44, 70 in operation.

Furthermore, a pair of stop lugs 74 are provided adjacent the cylindrical wall 68 of the inner plate 32. When assembled, the stop lugs 74 are received at cutouts 76 that reside in a front wall 78 of the inner plate 32. Projections of the stop lugs 74 ride in grooves 80 of the plate 34. The stop lugs 74 and the plate 34 serve to block and limit angularly displacement effected by the VCT phaser 10 amid advancing and retarding engine valve opening and closing. The rotor-clip 36 axially secures the plate 34, the inner plate 32, and the housing assembly 26 together.

When put in use, the VCT phaser 10 transfers rotation from the crankshaft 12 and to the camshaft 14, and, when commanded by a controller, can angularly displace the camshaft 14 with respect to its normal operating position to an advanced angular position or to a retarded angular position. Under normal operation and without valve advancing or retarding, the sprocket 38 is driven to rotate about the axis $X_1$ by the crankshaft 12 in a first direction (e.g., clockwise or counterclockwise) and at a first rotational speed. The first ring gear 44 also rotates in the first direction and at the first rotational speed. Concurrently, the electric motor 58 drives the sun gear 30 to rotate about the axis $X_1$ in the first direction and at the first rotational speed. In this scenario, the housing assembly 26, sun gear 30, first and second ring gears 44, 70, and inner plate 32 all rotate together in unison in the first direction and at the first rotational speed. Also, the planet gears 54 revolve together around the axis $X_1$ in the first direction and at the first rotational speed, and do not rotate about their individual rotational axes $X_2$. In other words, there is no relative rotational movement or relative rotational speed among the housing assembly 26, sun gear 30, planet gears 54, first and second ring gears 44, 70, and inner plate 32 in normal operation.

In an example, in order to bring the camshaft 14 to the advanced angular position, the electric motor 58 drives the sun gear 30 momentarily at a second rotational speed that is slower than the first rotational speed of the sprocket 38. This causes relative rotational movement and relative rotational speed between the sun gear 30 and sprocket 38. And since the first and second ring gears 44, 70 have a different number of individual teeth with respect to each other, the second ring gear 70 moves rotationally relative to the first ring gear 44. At the same time, the planet gears 54 rotate about their individual rotational axes $X_2$. The precise duration of driving the sun gear 30 at the second rotational speed will depend on the desired degree of angular displacement between the camshaft 14 and the sprocket 38. Once the desired degree of angular displacement is effected, the electric motor 58 will once again be commanded to drive the sun gear 30 at the first rotational speed. The camshaft 14 hence remains at the advanced angular position while the sun gear 30 is driven at the first rotational speed under these conditions.

To ensure that the VCT phaser 10 can advance and retard as described and as intended, an angular position of the gear set assembly 16 should be maintained amid installation procedures at the camshaft 14. When the center bolt 64 is tightened down in past installations, for instance, the torque exerted for tightening can get transferred through the gear set assembly 16 and can consequently rotationally dislocate the gear set assembly 16 from its proper angular position. Dislocation can upset timing of the VCT phaser 10 at the time of installation, and can in turn upset timing of the VCT phaser 10 in subsequent use. This can cause particular shortcomings in keyless timing applications in which the camshaft 14 lacks measures for locating the VCT phaser 10 relative to the camshaft 14 at installation.

A removable fixture 82 resolves these issues. The fixture 82 is removable in the sense that it can readily be secured and set in place pre-installation at the camshaft 14 such as at shipping, can remain in place during installation, and can then be withdrawn from securement post-installation and before employing the VCT phaser 10 in use. Securement of the fixture 82 is not permanent. When secured in place in the VCT phaser 10, and with reference to the embodiment involving the planetary gear set 24, the fixture 82 serves to maintain the angular positions of the housing assembly 26, carrier assembly 28, sun gear 30, and inner plate 32. A known angular position of the housing assembly 26 with respect to a known angular position of the inner plate 32 is hence maintained via the fixture 82. In particular, in different embodiments the fixture 82 constrains rotational movement of the first and second ring gears 44, 70, planet gears 54, and sun gear 30, thereby fixing and rendering immobile relative rotational movement between the housing assembly 26 and inner plate 32. Keeping the angular positions at known states before installation ensures that the VCT phaser 10 can be set for intended and proper timing with the camshaft 14 after installation, and even in keyless timing applications. Moreover, keeping the angular positions at known states amid installation and even as torque is exerted to the planetary gear set 24 when the center bolt 64 is tightened down further ensures that the timing setting endures after installation. Dislocations experienced in past installations are precluded. In addition, the fixture 82 and constraint it provides establish a more suitable torque load path through the planetary gear set 24 whereby gears and components of the planetary gear set 24 can more readily withstand the torque loads exerted when the center bolt 64 is tightened down.

In the embodiments presented, the fixture 82 lacks direct securement between the input gear 18 and the output gear 20 which, in the embodiments of the planetary gear set 24, also means an absence of direct securement between the first ring gear 44 and the second ring gear 70. Direct securement in this regard is used to indicate that the fixture 82, when put in place, does not immediately and directly engage (and hence tie together) both of the input gear 18 and the output gear 20 and both of the first ring gear 44 and the second ring gear 70. The embodiments described herein are examples that lack such direct securement. Instead, the fixture 82 directly engages at least one intermediate moving component that is situated in the path of rotational transmission between the input gear 18 and the output gear 20. In the embodiments of the planetary gear set 24, this intermediate moving component can be, for example, one of the carrier plates 48, 50, one of the planet gears 54, and/or the sun gear 30. In embodiments of other gearbox types (e.g., harmonic drive gearbox, eccentric gearbox, cycloidal gearbox), the intermediate moving component would be an analogous component.

Figure 4:
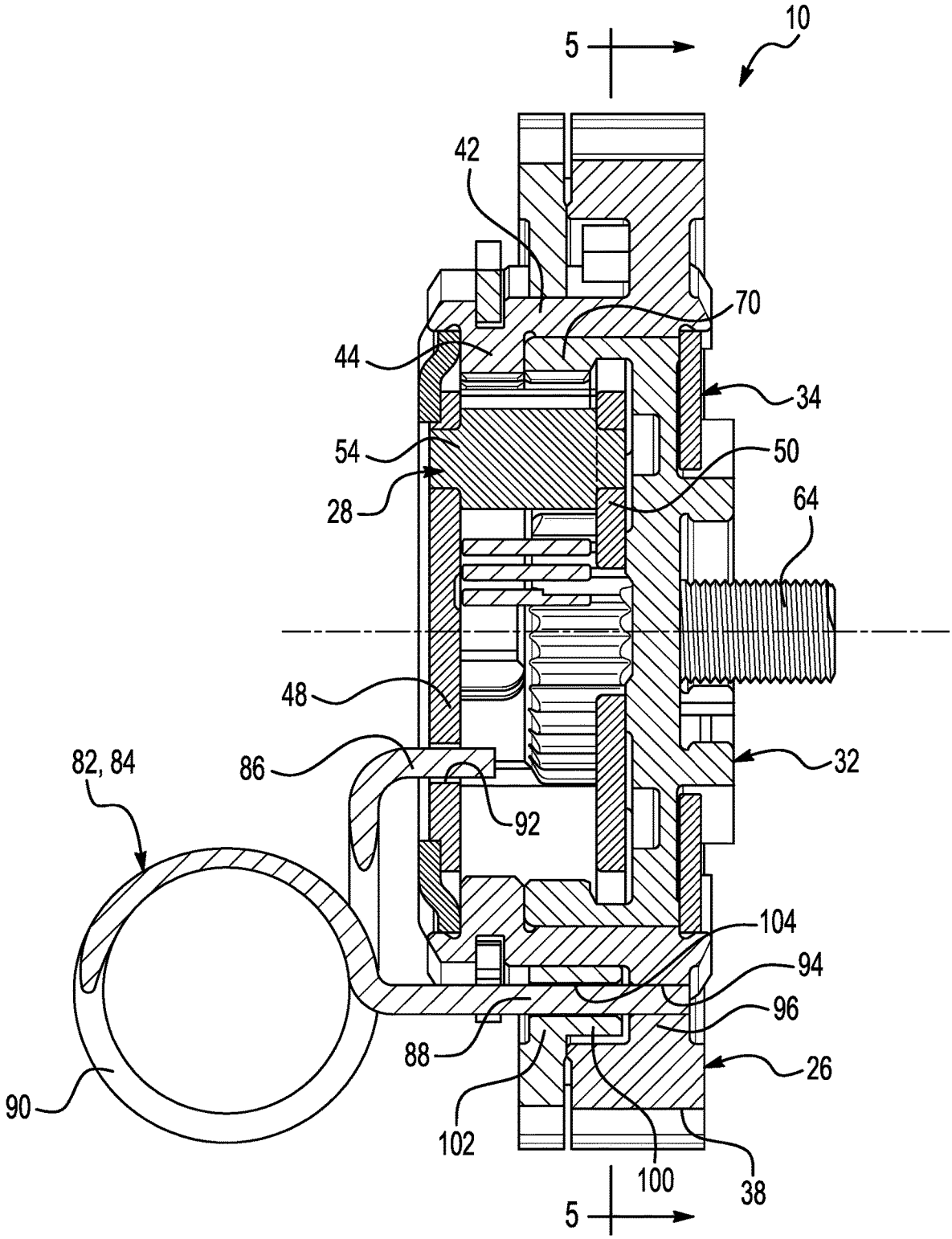
FIG. 4 is a sectional view of the electrically-actuated VCT phaser and fixture of FIG. 3.
Figure 5:
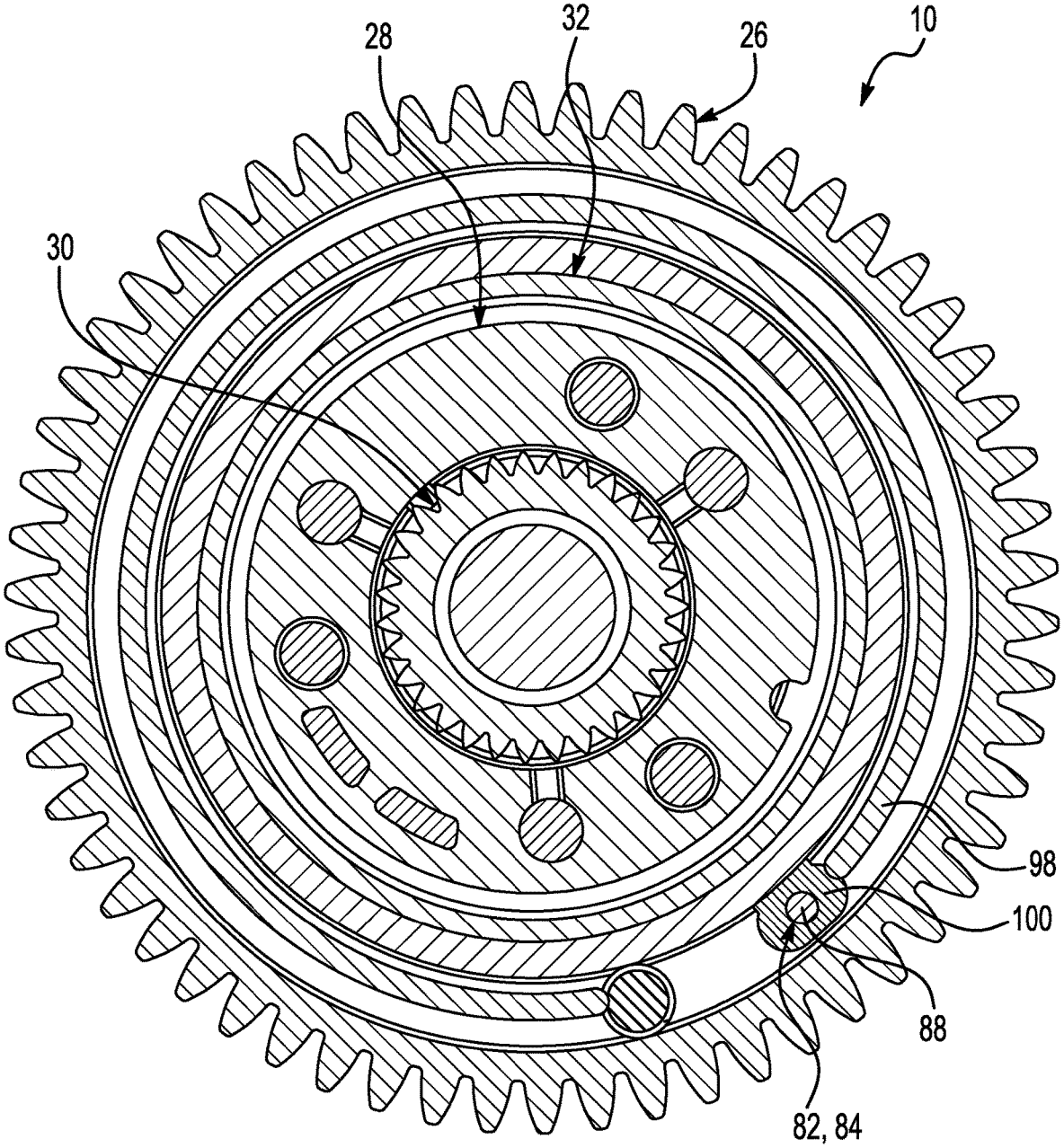
FIG. 5 is another sectional view of the electrically-actuated VCT phaser and fixture of FIG. 3, this sectional view taken at arrowed lines 5-5 in FIG. 4.

The fixture 82 can have various designs and constructions and components in different embodiments depending upon, among other possible factors, the VCT phaser 10 in which the fixture 82 is employed and the components of the VCT phaser 10 that the fixture 82 temporarily ties together. A first embodiment of the fixture 82 is presented in FIGS. 3-5. In this embodiment the fixture 82 ties together the first carrier plate 48 and the housing assembly 26. Because of this fixation, the fixture 82 constrains rotational movement of the first and second ring gears 44, 70, planet gears 54, and sun gear 30, thereby constraining relative rotational movement between the housing assembly 26 and inner plate 32. The fixture 82 here is in the form of a pin 84. The pin 84 has a unitary, single-piece construction, and can be composed of a metal material. In one example, a cross-sectional diameter of the pin 84 can be 1.6 millimeters (mm); still, other diameter values are possible in other examples. With particular reference to FIG. 4, the pin 84 has a first prong 86, a second prong 88, and a bridge 90 extending between the first and second prongs 86, 88. The first and second prongs 86, 88 are uni-directional and geometrically straight along their respective extents. When put in place, as depicted in FIG. 4, the first and second prongs 86, 88 are directed axially relative to the circular shape of the VCT phaser 10, and exhibit a parallel relationship with each other. The second prong 88 has a greater length than the first prong 86. The bridge 90 is loop-shaped and presents a ring for an installer to put the pin 84 in place and remove it by hand.

For receiving insertion of the pin's first prong 86, the first carrier plate 48 has a first opening 92 residing in its structure. The first opening 92 complements the circular shape of the first prong 86 and spans wholly through the first carrier plate 48. In a similar way, for receiving insertion of the pin's second prong 88, the housing assembly 26 has a second opening 94 residing in its structure. The second opening 94 is located in a radially-extending wall 96 of the sprocket 38. The radially-extending wall 96 extends radially-outboard of the wall 42. The second opening 94 complements the circular shape of the second prong 88 and spans wholly through the radially-extending wall 96.

In the first embodiment, the fixture 82 serves an additional function. In certain VCT phasers, and with reference now to FIG. 5, a backlash spring 98 is provided as a component of the VCT phaser 10. The backlash spring 98 exerts a biasing force that is intended to take-up any backlash that may exist among gear teeth of the input gear 18 (i.e., in this embodiment, the sprocket 38) and the timing chain or belt. These gear teeth are urged together via the backlash spring 98. In the embodiment here, the backlash spring 98 is in the form of a scissor gear spring. The backlash spring 98 presses directly against an extension 100 of the inner plate 32. The extension 100 extends axially from a radially-extending wall 102. When the gear teeth are urged together, it presents a challenge amid installation procedures at the camshaft 14—typically, the gear teeth have to be slightly separated from each other against the spring's urging for proper installation. To ease installation and preclude the effect of the biasing force, the pin's second prong 88 is also inserted through a third opening 104 residing in the inner plate 32. The third opening 104 is located in the radially-extending wall 102 and in the extension 100. The third opening 104 complements the circular shape of the second prong 88 and spans wholly through the radially-extending wall 102 and the extension 100. With the pin's second prong 88 in place and through the second and third openings 94, 104, as depicted in FIG. 4, the gear teeth are kept slightly separated from each other.

Figure 6:
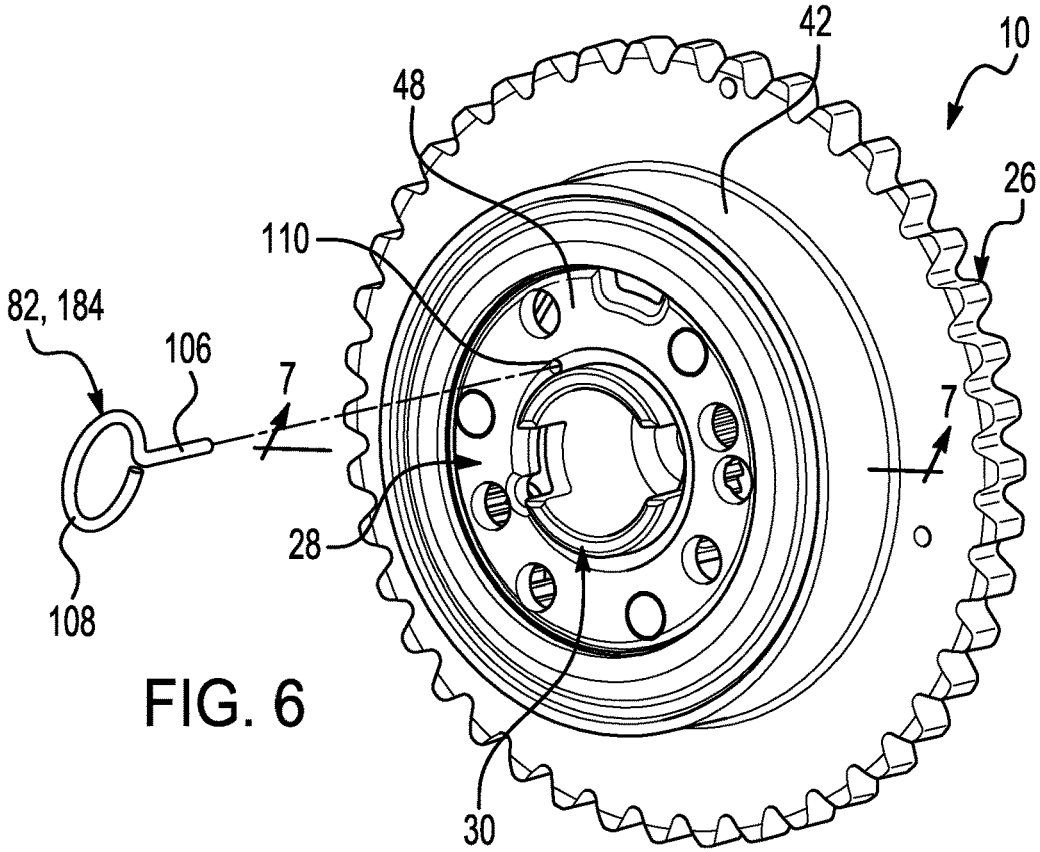
FIG. 6 is a perspective view of another embodiment of the electrically-actuated VCT phaser and fixture.
Figure 7:
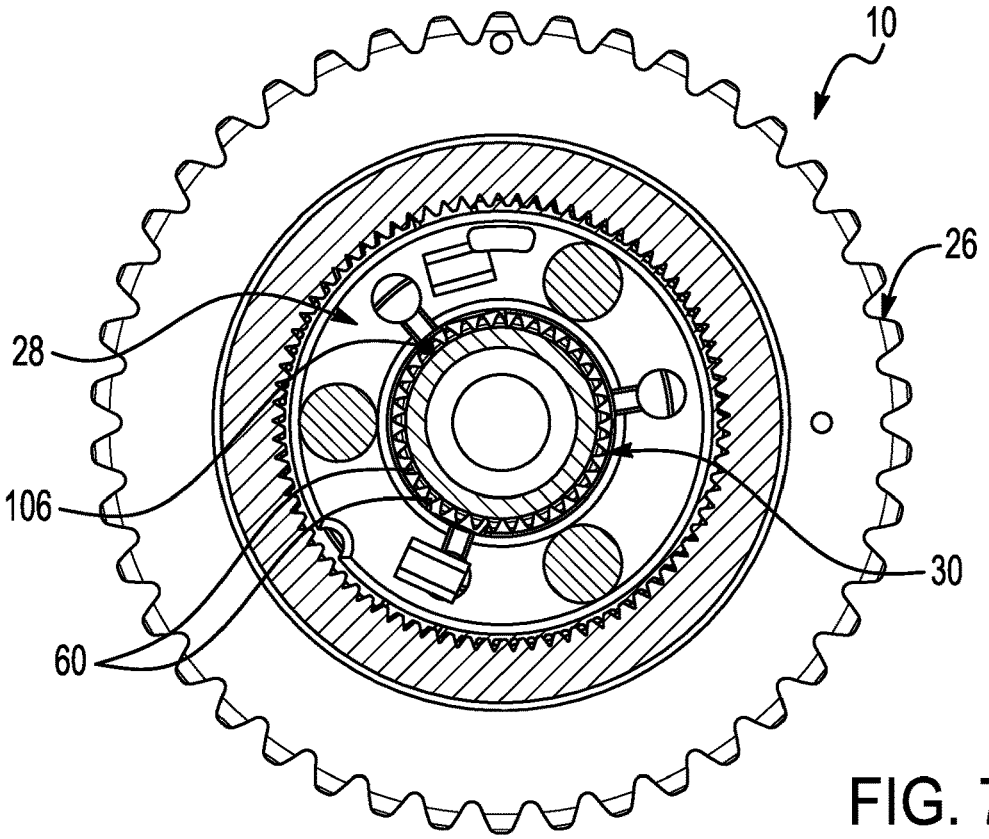
FIG. 7 is a sectional view of the electrically-actuated VCT phaser and fixture of FIG. 6, this sectional view taken at arrowed lines 7-7 in FIG. 6.

A second embodiment of the fixture 82 is presented in FIGS. 6 and 7. In FIG. 6, the fixture 82 is depicted exploded and removed from the VCT phaser 10; in FIG. 7, the fixture 82 is shown put in place. In this embodiment the fixture 82 ties together the first carrier plate 48 and the sun gear 30. Because of this fixation, the fixture 82 constrains rotational movement of the first and second ring gears 44, 70, planet gears 54, and sun gear 30, thereby constraining relative rotational movement between the housing assembly 26 and inner plate 32. The fixture 82 here is in the form of a pin 184. The pin 184 has a unitary, single-piece construction, and can be composed of a metal material. In one example, a cross-sectional diameter of the pin 184 can be 1.6 mm; still, other diameter values are possible in other examples. With particular reference to FIG. 6, the pin 184 has a single prong 106 and a bridge 108 extending therefrom. The prong 106 is uni-directional and geometrically straight along its extent. When put in place, the prong 106 is directed axially relative to the circular shape of the VCT phaser 10. The bridge 108 is loop-shaped and presents a ring for an installer to put the pin 184 in place and remove it by hand. For receiving insertion of the pin's prong 106, the first carrier plate 48 has an opening 110 residing in its structure. The opening 110 complements the circular shape of the prong 106 and spans wholly through the first carrier plate 48 in the axial direction. With particular reference to the sectional view of FIG. 7, when the pin 184 is put in place in the VCT phaser 10, the pin's prong 106 goes through the opening 110 and gets situated and sandwiched between a pair of individual and neighboring teeth 60 of the sun gear 30 adjacent a terminal end section of the pin 184. Due to the position of the prong 106, the pin 184 fixes rotational movement of the sun gear 30 to the first carrier plate 48.

Figure 8:
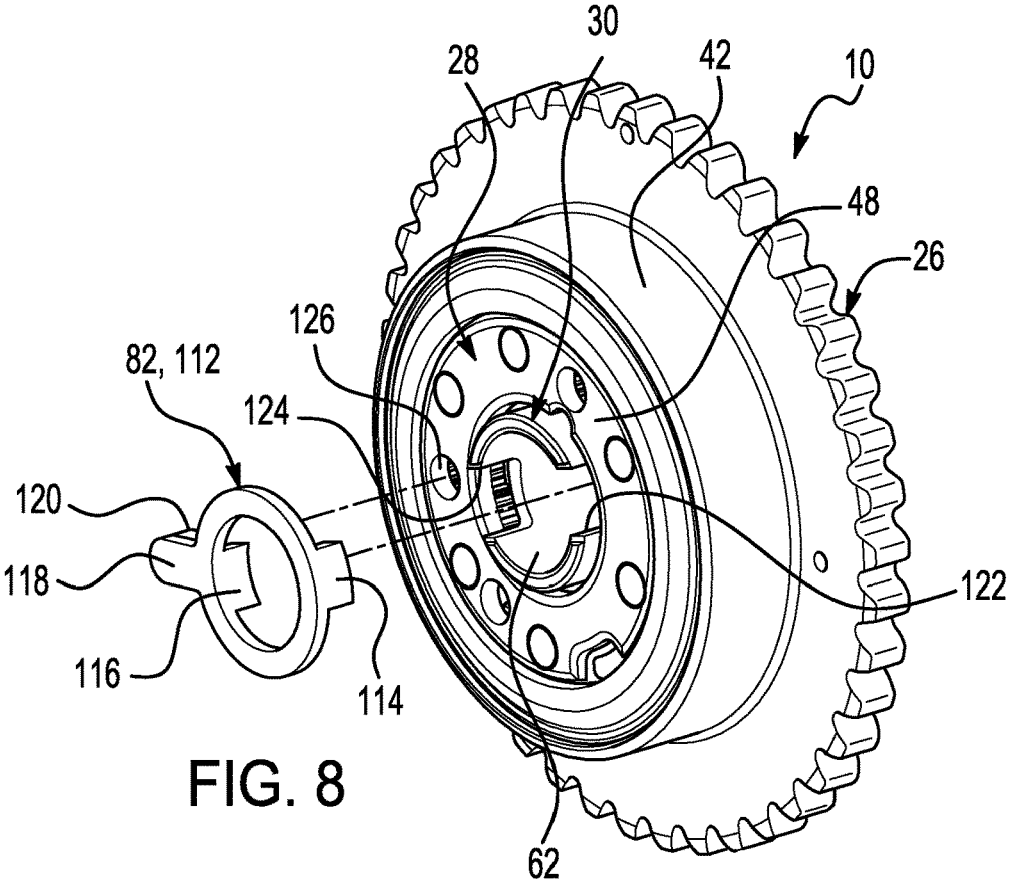
FIG. 8 is a perspective view of another embodiment of the electrically-actuated VCT phaser and fixture.
Figure 9:
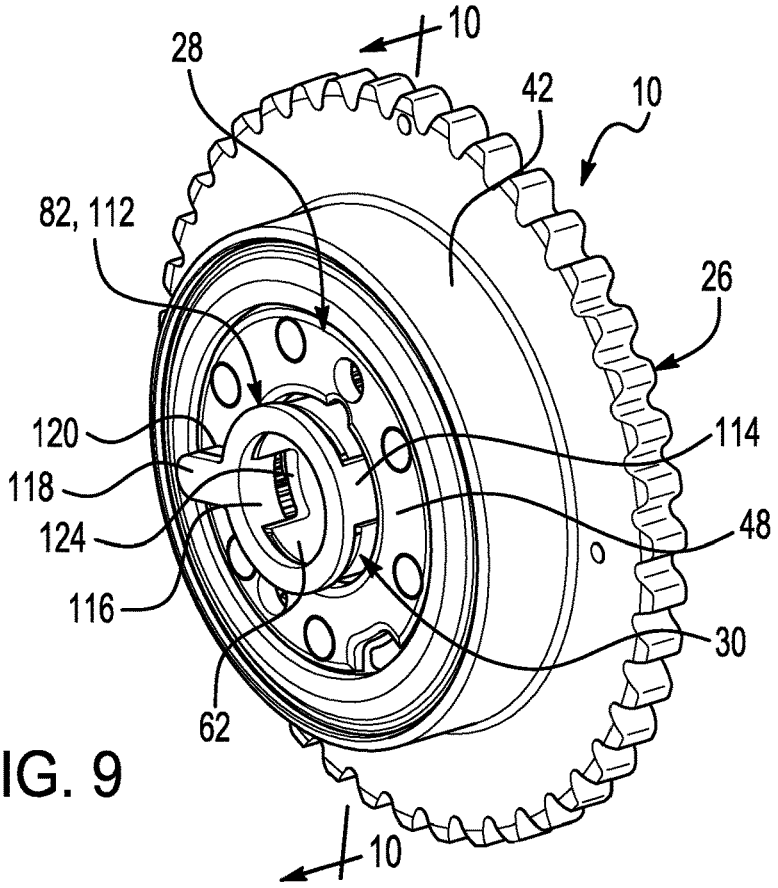
FIG. 9 is another perspective view of the electrically-actuated VCT phaser and fixture of FIG. 8.
Figure 10:
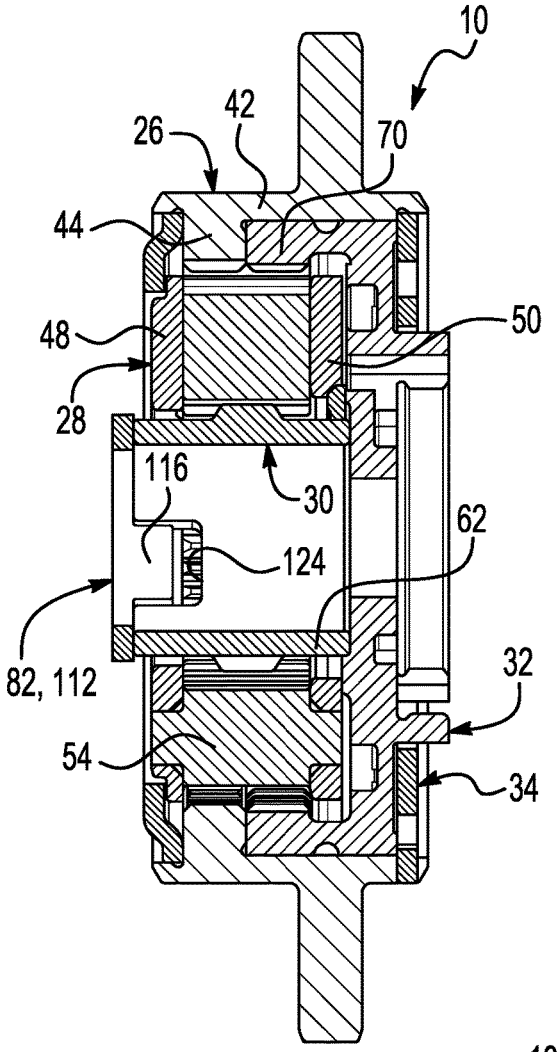
FIG. 10 is a sectional view of the electrically-actuated VCT phaser and fixture of FIG. 8, this sectional view taken at arrowed lines 10-10 in FIG. 9.

A third embodiment of the fixture 82 is presented in FIGS. 8, 9, and 10. In FIG. 8, the fixture 82 is depicted exploded and removed from the VCT phaser 10; in FIGS. 9 and 10, the fixture 82 is shown put in place. In this embodiment the fixture 82 ties together the first carrier plate 48 and the sun gear 30. Because of this fixation, the fixture 82 constrains rotational movement of the first and second ring gears 44, 70, planet gears 54, and sun gear 30, thereby constraining relative rotational movement between the housing assembly 26 and inner plate 32. The fixture 82 here is in the form of a body 112. The body 112 has a unitary, single-piece construction, and can be composed of a plastic material. A main portion of the body 112 has an annular shape. The annular shape complements the cylindrical shape of the sun gear 30 in terms of its size and shape. A first axial extension 114 extends from the main portion of the body 112 in an axial direction relative to the annular shape, and a second axial extension 116 extends from the main portion of the body 112 in an axial direction relative to the annular shape; still, in other embodiments only one of the first or second axial extensions could be provided rather than both of them. The first and second axial extensions 114, 116 are located opposite each other on the main portion of the body 112. A radial extension 118 extends from a side of the body's main portion, and a third axial extension 120 extends directly from the radial extension 118 in an axial direction relative to the annular shape of the body 112.

The sun gear 30 is slotted at its cylindrical wall 62 for interconnection with the electric motor 58. A first slot 122 resides on one side of the cylindrical wall 62, and a second slot 124 resides on an opposite side of the cylindrical wall 62. The first and second slots 122, 124 are accessible via an upper open end of the sun gear 30. The first and second slots 122, 124 are features designed into the sun gear 30 for receipt of rotational drive from the electric motor 58. The first axial extension 114 complements the first slot 122 in terms of size and shape, and the second axial extension 116 likewise complements the second slot 124 in terms of size and shape. When the body 112 is put in place in the VCT phaser 10, the first axial extension 114 is inserted and received in the first slot 122, and the second axial extension 116 is inserted and received in the second slot 124. The first carrier plate 48 has multiple openings residing in its structure for support of the cylinders 52 and for support of the planet gears 54. One of the openings, opening 126, receives insertion of the third axial extension 120 when the body 112 is put in place in the VCT phaser 10. The third axial extension 120 complements the opening 126 in terms of size and shape. Due to the receptions and insertions among the first, second, and third axial extensions 114, 116, and 120 and the first and second slots 122, 124 and opening 126, the body 112 fixes rotational movement of the sun gear 30 to the first carrier plate 48.

Figure 11:
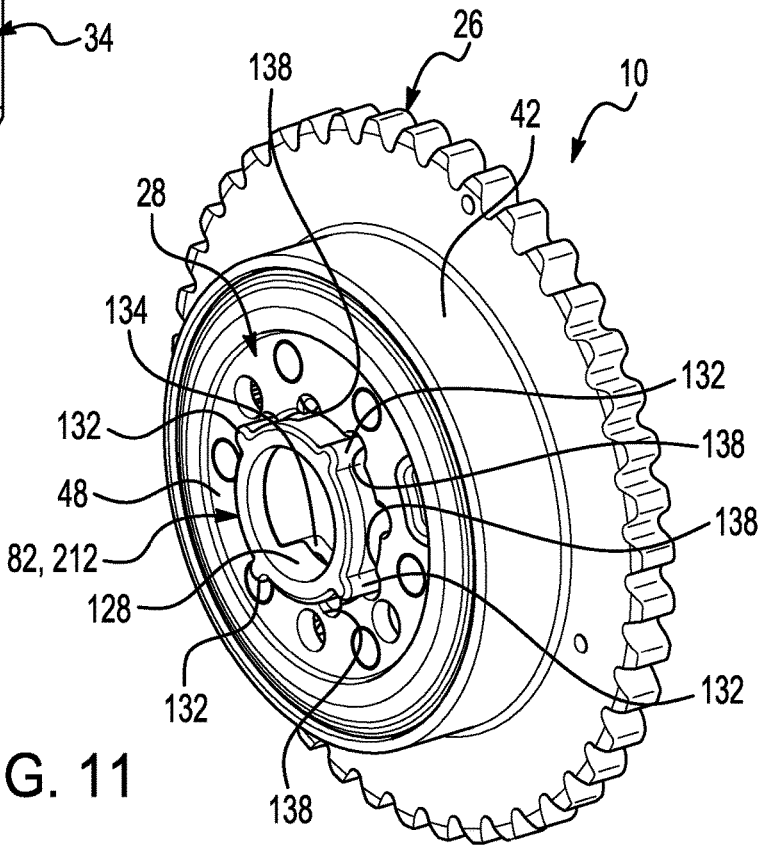
FIG. 11 is a perspective view of another embodiment of the electrically-actuated VCT phaser and fixture.
Figure 12:
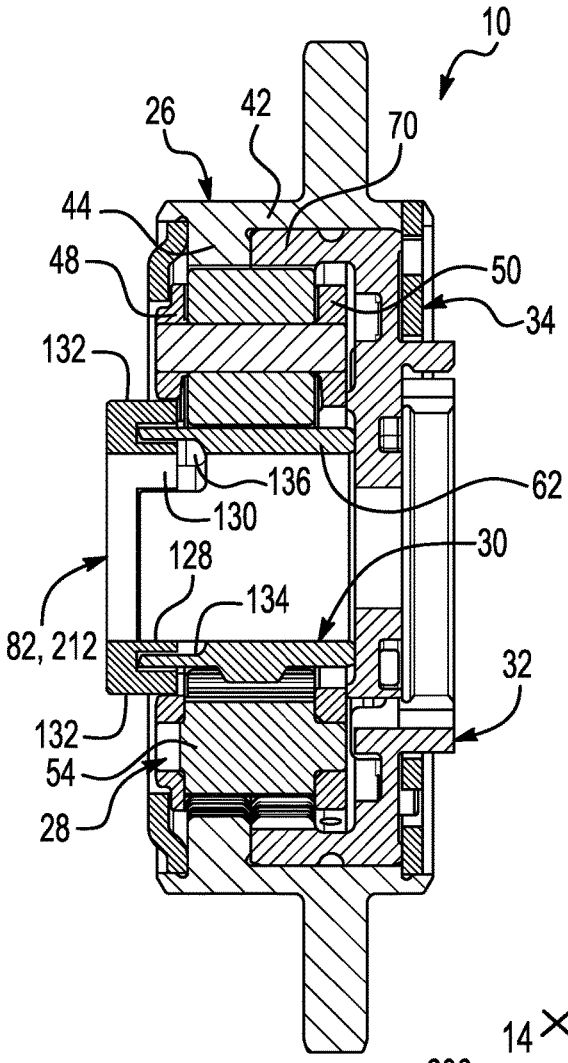
FIG. 12 is a sectional view of the electrically-actuated VCT phaser and fixture of FIG. 11.

A fourth embodiment of the fixture 82 is presented in FIGS. 11 and 12. In FIGS. 11 and 12, the fixture 82 is shown put in place. In this embodiment the fixture 82 ties together the first carrier plate 48 and the sun gear 30. Because of this fixation, the fixture 82 constrains rotational movement of the first and second ring gears 44, 70, planet gears 54, and sun gear 30, thereby constraining relative rotational movement between the housing assembly 26 and inner plate 32. The fixture 82 here is in the form of a body 212. The body 212 has a unitary, single-piece construction, and can be composed of a plastic material. The body 212 has an annular and cylindrical shape that complements the size and shape of the sun gear 30. A first axial extension 128 extends from a main portion of the body 212 in an axial direction relative to the annular shape, and a second axial extension 130 extends from the main portion of the body 212 in an axial direction relative to the annular shape; still, in other embodiments only one of the first or second axial extensions could be provided rather than both of them. The first and second axial extensions 128, 130 are located opposite each other on the main portion of the body 212. Furthermore, multiple lobes 132 extend from the main portion of the body 212 in a radial direction relative to the annular shape. The lobes 132, four in all, project and bulge radially-outwardly from an outer surface of the main portion of the body 212. The lobes 132 are equally spaced around the circumference of the main portion of the body 212.

The sun gear 30 is slotted at its cylindrical wall 62 for interconnection with the electric motor 58. A first slot 134 resides on one side of the cylindrical wall 62, and a second slot 136 resides on an opposite side of the cylindrical wall 62. The first and second slots 134, 136 are accessible via an upper open end of the sun gear 30. The first and second slots 134, 136 are features designed into the sun gear 30 for receipt of rotational drive from the electric motor 58. The first axial extension 128 complements the first slot 134 in terms of size and shape, and the second axial extension 130 likewise complements the second slot 136 in terms of size and shape. When the body 212 is put in place in the VCT phaser 10, the first axial extension 128 is inserted and received in the first slot 134, and the second axial extension 130 is inserted and received in the second slot 136. The carrier plate 48 has multiple recesses 138 residing in its structure at a radially-inboard-most inner surface of the first carrier plate 48. The quantity of the recesses 138 and their locations can correspond to the quantity and locations of the lobes 132, for example. In the embodiment shown, there are eight recesses 138 in total; still, in other embodiments there could be a single lobe and a single recess. The recesses 138 span radially-outwardly in the first carrier plate 48, and complement the lobes 132 in terms of size and shape. Four of the recesses 138 receive insertion of the four lobes 132 when the body 212 is put in place in the VCT phaser 10. Due to the receptions and insertions among the first and second axial extensions 128, 130 and first and second slots 134, 136, and among the lobes 132 and recesses 138, the body 212 fixes rotational movement of the sun gear 30 to the first carrier plate 48.

Figure 13:
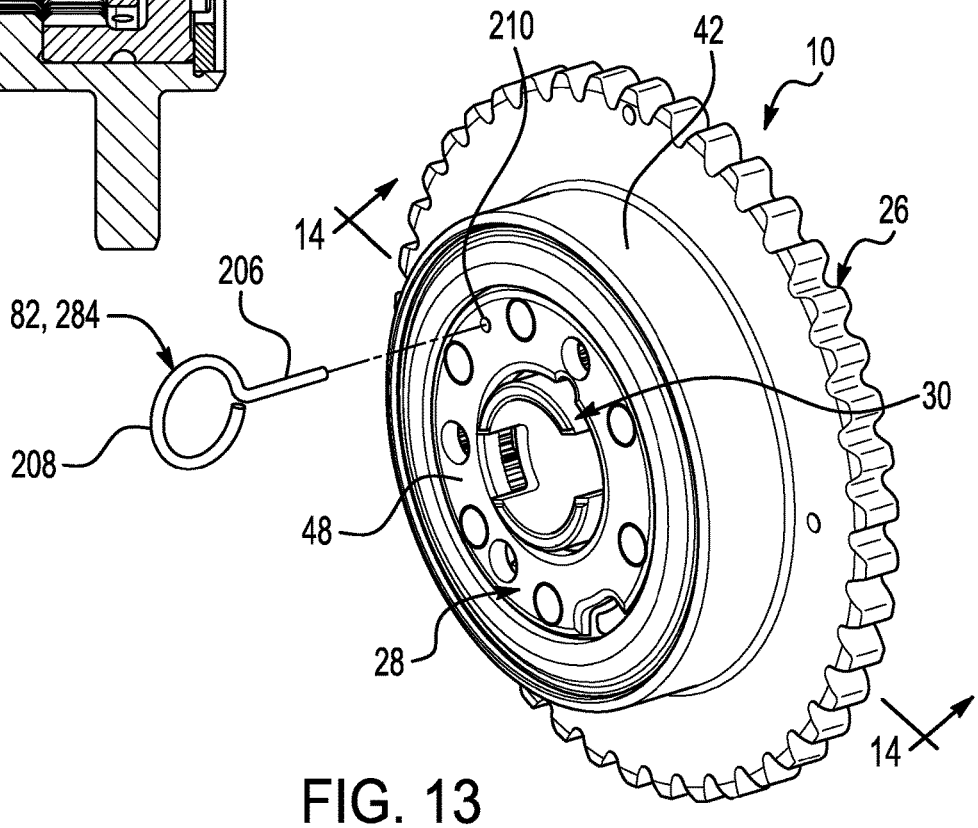
FIG. 13 is a perspective view of another embodiment of the electrically-actuated VCT phaser and fixture.
Figure 14:
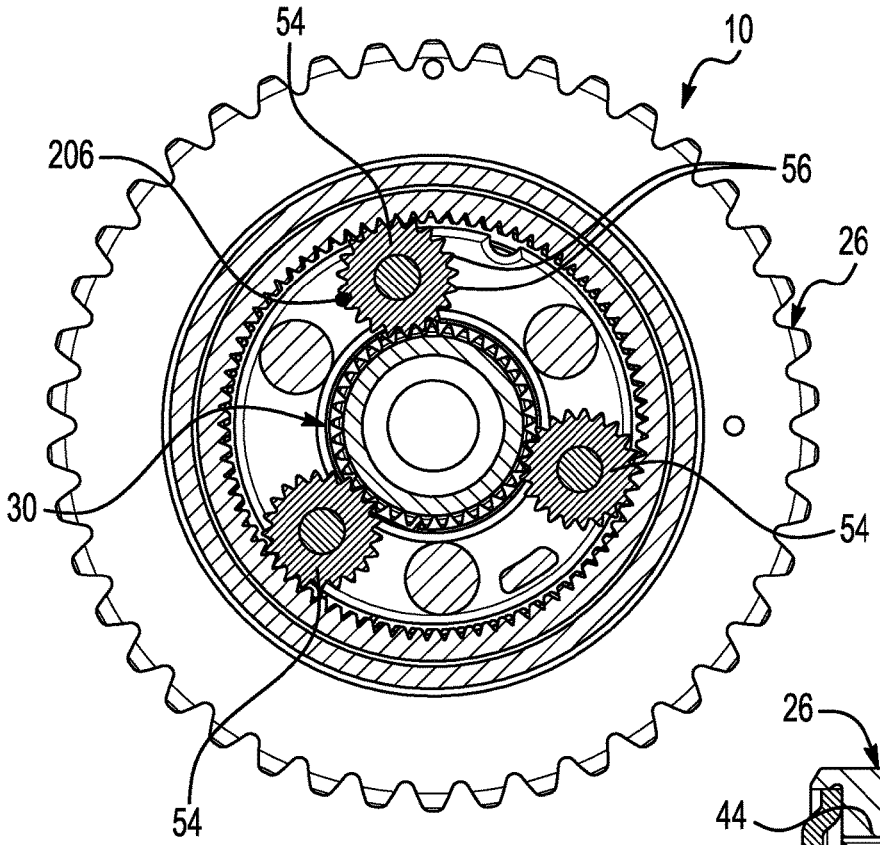
FIG. 14 is a sectional view of the electrically-actuated VCT phaser and fixture of FIG. 13, this sectional view taken at arrowed lines 14-14 in FIG. 13.

A fifth embodiment of the fixture 82 is presented in FIGS. 13 and 14. In FIG. 13, the fixture 82 is depicted exploded and removed from the VCT phaser 10; in FIG. 14, the fixture 82 is shown put in place. In this embodiment the fixture 82 ties together the first carrier plate 48 and one of the planet gears 54. Because of this fixation, the fixture 82 constrains rotational movement of the first and second ring gears 44, 70, planet gears 54, and sun gear 30, thereby constraining relative rotational movement between the housing assembly 26 and inner plate 32. The fixture 82 here is in the form of a pin 284. The pin 284 has a unitary, single-piece construction, and can be composed of a metal material. In one example, a cross-sectional diameter of the pin 284 can be 1.6 mm; still, other diameter values are possible in other examples. With particular reference to FIG. 13, the pin 284 has a single prong 206 and a bridge 208 extending therefrom. The prong 206 is uni-directional and geometrically straight along its extent. When put in place, the prong 206 is directed axially relative to the circular shape of the VCT phaser 10. The bridge 208 is loop-shaped and presents a ring for an installer to put the pin 284 in place and remove it by hand. For receiving insertion of the pin's prong 206, the first carrier plate 48 has an opening 210 residing in its structure. The opening 210 complements the circular shape of the prong 206 and spans wholly through the first carrier plate 48 in the axial direction. With particular reference to the sectional view of FIG. 14, when the pin 284 is put in place in the VCT phaser 10, the pin's prong 206 goes through the opening 210 and gets situated and sandwiched between a pair of individual and neighboring teeth 56 of one of the planet gears 54 adjacent a terminal end section of the pin 284. Due to the position of the prong 206, the pin 284 fixes rotational movement of one of the planet gears 54 to the first carrier plate 48.

Figure 15:
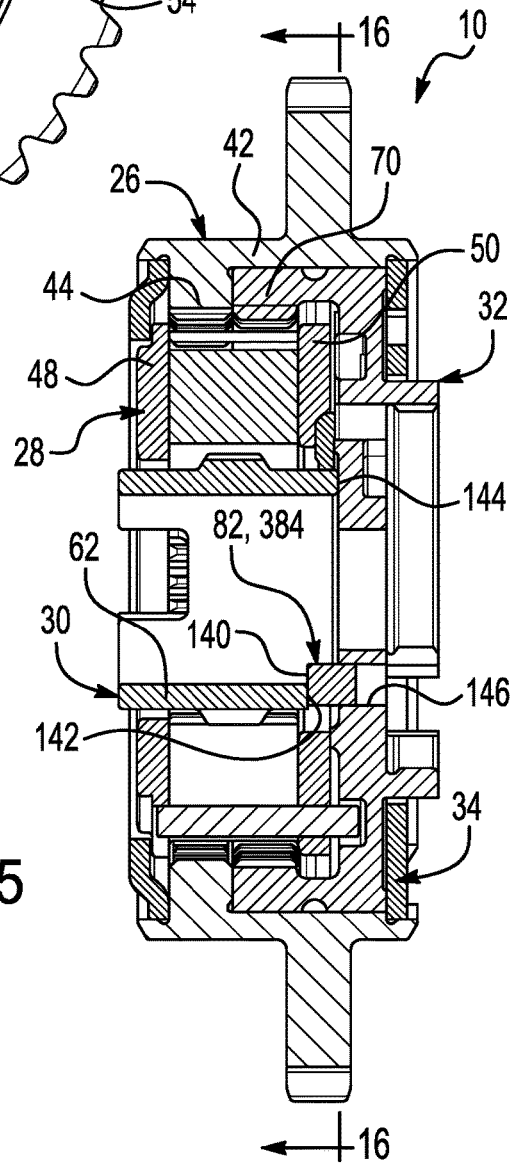
FIG. 15 is a sectional view of another embodiment of the electrically-actuated VCT phaser and fixture.
Figure 16:
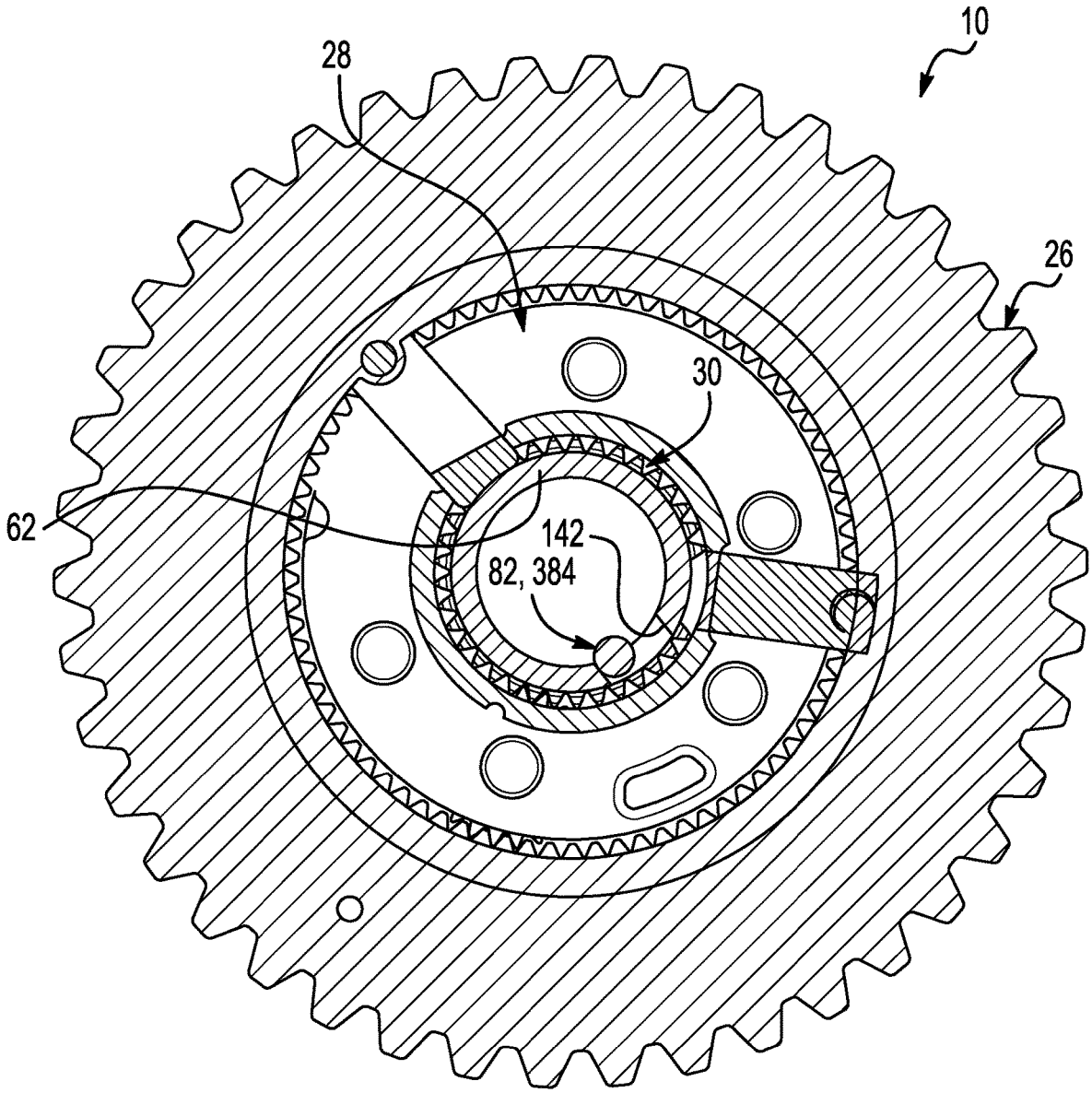
FIG. 16 is another sectional view of the electrically-actuated VCT phaser and fixture of FIG. 15, this sectional view taken at arrowed lines 16-16 in FIG. 15.
Figure 17:
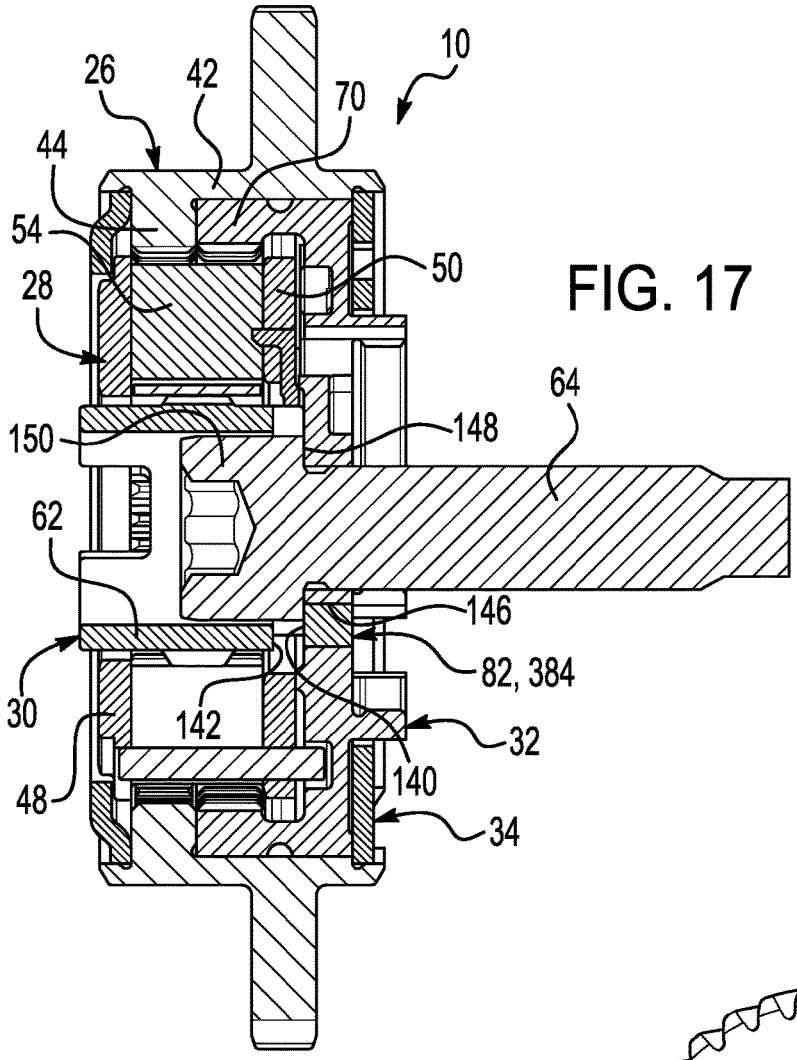
FIG. 17 is yet another sectional view of the electrically-actuated VCT phaser and fixture of FIG. 15.

A sixth embodiment of the fixture 82 is presented in FIGS. 15, 16, and 17. In FIGS. 15 and 16, the center bolt 64 is absent and the fixture 82 is shown in a state of fixation; and in FIG. 17, the center bolt 64 is shown tightened down and the fixture 82 is in a state of release. In this embodiment, the fixture 82 ties together the inner plate 32 and the sun gear 30 when the fixture 82 is in the state of fixation. Because of this fixation, the fixture 82 constrains rotational movement of the first and second ring gears 44, 70, planet gears 54, and sun gear 30, thereby constraining relative rotational movement between the housing assembly 26 and inner plate 32. The fixture 82 here is in the form of a pin 384. The pin 384 is of the spiral roll pin type, has a unitary and single-piece construction, and can be composed of a metal material. The pin 384 has an upper axial end 140. In this embodiment, the sun gear 30 has a slot 142 residing at its lower open end 144. The sun gear 30 constitutes an intermediate member in this embodiment, but the intermediate member can be other types of gears or components in other embodiments such as the harmonic drive gearbox embodiment, eccentric gearbox embodiment, or cycloidal gearbox embodiment. The slot 142 resides in the cylindrical wall 62 and spans wholly therethrough in the radial direction. The slot 142 has an open axial end. The slot 142 is sized and shaped to receive insertion of a portion or more of the pin 384 when the fixture 82 is in its state of fixation. For receiving insertion of the pin 384, the inner plate 32 has an opening 146 residing in its structure. A portion of the pin 384 is inserted in the opening 146 in the state of fixation (FIG. 15), and the whole of the pin 384 is received in the opening 146 in the state of release (FIG. 17). The opening 146 complements the size and shape of the pin 384, and spans wholly through the inner plate 32 in the axial direction. Before the center bolt 64 is installed and tightened down, the pin 384 is partially inserted and received in both of the slot 142 and opening 146, as depicted in FIG. 15. When the center bolt 64 is installed and tightened down, the center bolt 64 comes into direct abutment with the pin 384 and displaces the pin 384 in the axial direction. A bottom surface 148 of a head 150 of the center bolt 64 directly abuts the upper axial end 140 of the pin 384. The pin 384 is urged and displaced out of its previous reception of the slot 142, and is pushed fully into the opening 146. When this occurs, the fixture 82 is brought to its state of release and the gears and components of the VCT phaser 10 are no longer constrained from rotational movement via the pin 384.

Figure 18:
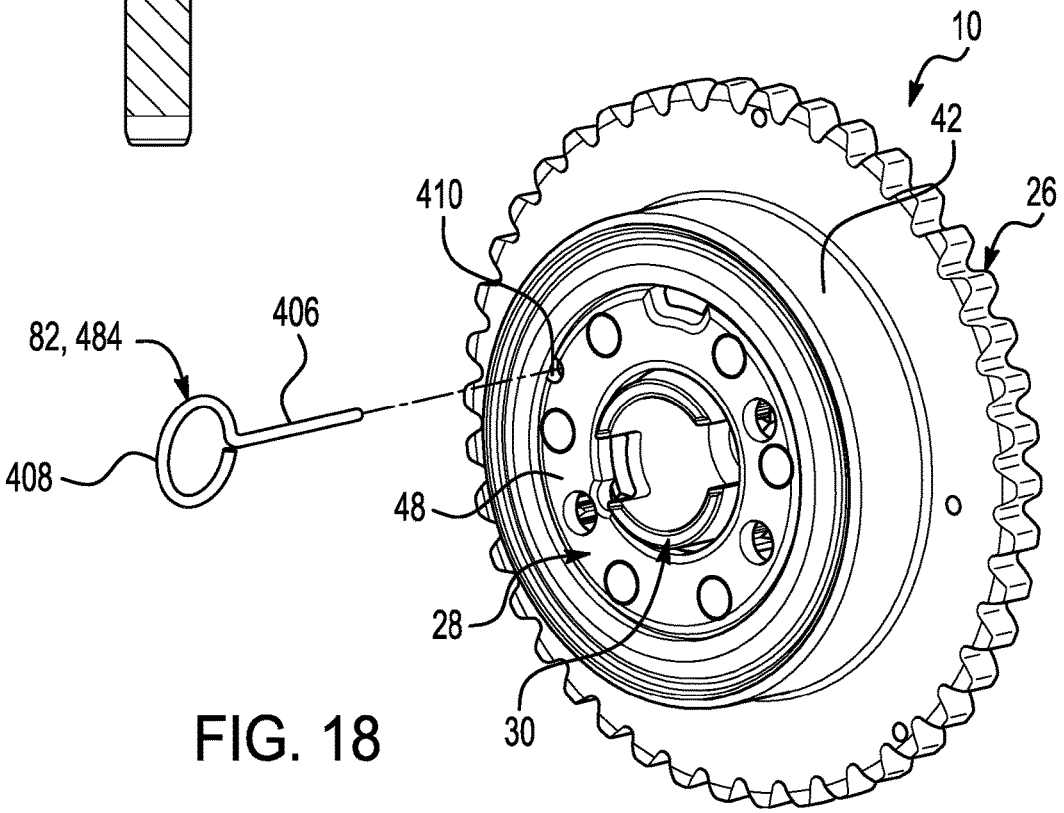
FIG. 18 is a perspective view of another embodiment of the electrically-actuated VCT phaser and fixture.
Figure 19:
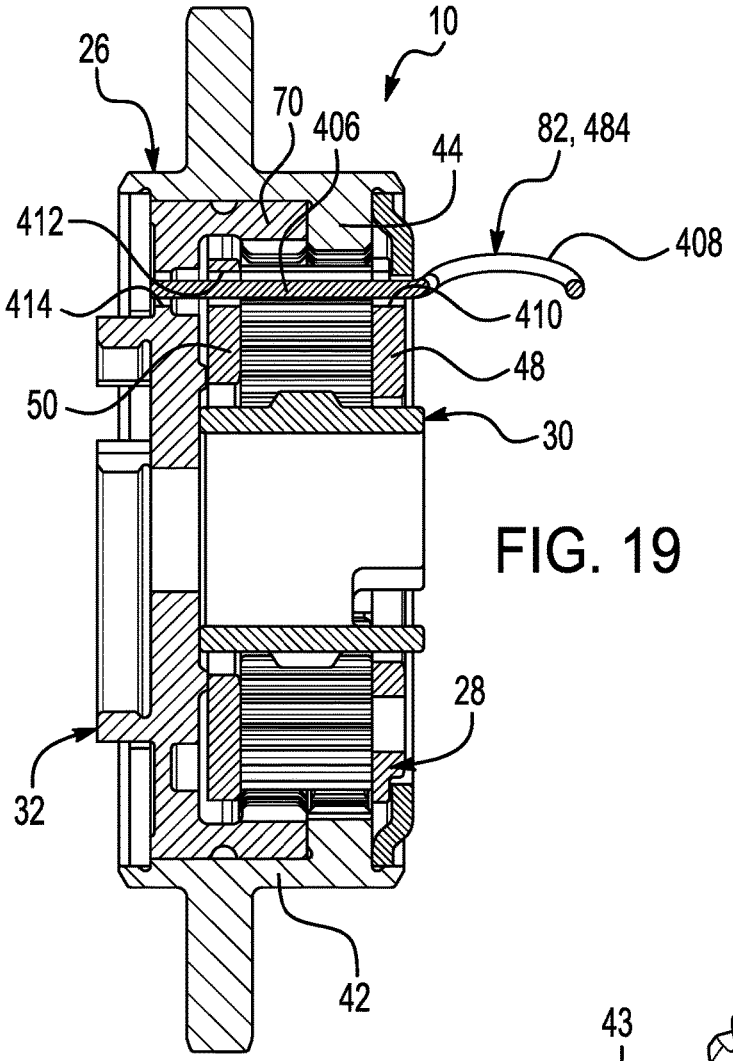
FIG. 19 is a sectional view of the electrically-actuated VCT phaser and fixture of FIG. 18.

A seventh embodiment of the fixture 82 is presented in FIGS. 18 and 19. In FIG. 18, the fixture 82 is depicted exploded and removed from the VCT phaser 10; in FIG. 19, the fixture 82 is shown put in place. In this embodiment the fixture 82 ties together the first carrier plate 48 and second carrier plate 50 and the inner plate 32. Because of the fixation, the fixture 82 constrains rotational movement of the first and second ring gears 44, 70, planet gears 54, and sun gear 30, thereby constraining relative rotational movement between the housing assembly 26 and inner plate 32. The fixture 82 here is in the form of a pin 484. The pin 484 has a unitary, single-piece construction, and can be composed of a metal material. In one example, a cross-sectional diameter of the pin 484 can be 1.6 mm; still, other diameter values are possible in other examples. With particular reference to FIG. 18, the pin 484 has a single prong 406 and a bridge 408 extending therefrom. The prong 406 is uni-directional and geometrically straight along its extent. When put in place, the prong 406 is directed axially relative to the circular shape of the VCT phaser 10. The bridge 408 is loop-shaped and presents a ring for an installer to put the pin 484 in place and remove it by hand. For receiving insertion of the pin's prong 406, the first carrier plate 48 has a first opening 410 residing in its structure and the second carrier plate 50 has a second opening 412 residing in its structure. The first and second openings 410, 412 complement the circular shape of the prong 406, and span wholly through the respective first and second carrier plate 48, 50 in the axial direction. With particular reference to the sectional view of FIG. 19, when the pin 484 is put in place in the VCT phaser 10, the pin's prong 406 goes through the first and second openings 410, 412. For receiving insertion of a terminal end section of the pin 484, the inner plate 32 has a third opening 414 residing in its structure. The third opening 414 complements the circular shape of the prong 406, and spans wholly through the inner plate 32 in the axial direction. When the pin 484 is put in place in the VCT phaser 10, the terminal end section of the pin's prong 406 goes through the third opening 414. Due to the position of the prong 406, the pin 484 fixes rotational movement of the inner plate 32 to the first and second carrier plate 48, 50.

Figure 20:
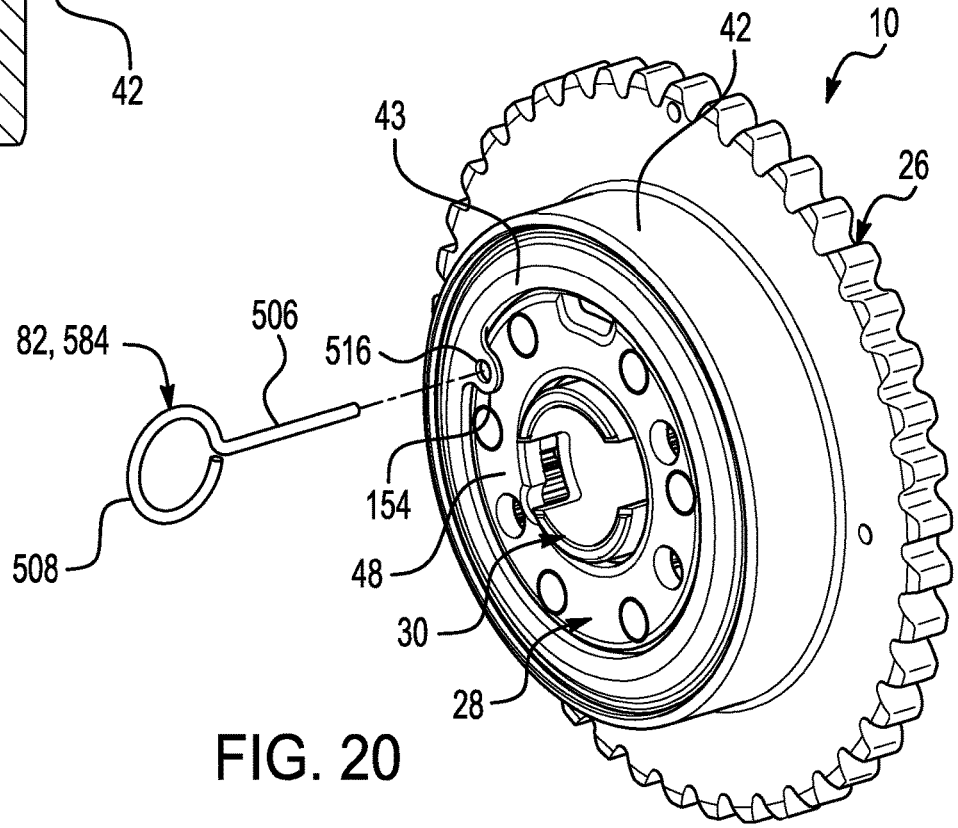
FIG. 20 is a perspective view of another embodiment of the electrically-actuated VCT phaser and fixture.
Figure 21:
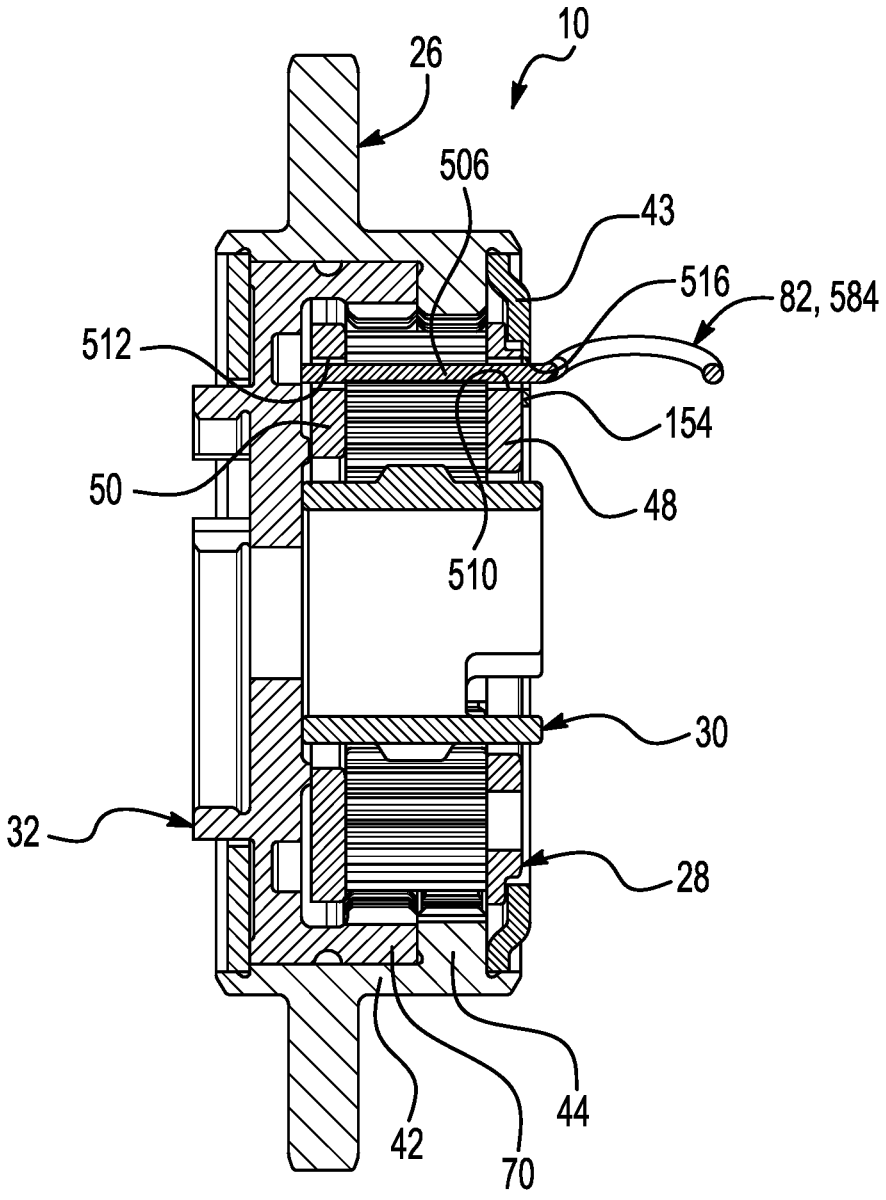
FIG. 21 is a sectional view of the electrically-actuated VCT phaser and fixture of FIG. 20.

An eighth embodiment of the fixture 82 is presented in FIGS. 20 and 21. In FIG. 20, the fixture 82 is depicted exploded and removed from the VCT phaser 10; in FIG. 21, the fixture 82 is shown put in place. In this embodiment the fixture 82 ties together the first carrier plate 48 and second carrier plate 50 and the outer retaining plate 43. Because of the fixation, the fixture 82 constrains rotational movement of the first and second ring gears 44, 70, planet gears 54, and sun gear 30, thereby constraining relative rotational movement between the housing assembly 26 and inner plate 32. The fixture 82 here is in the form of a pin 584. The pin 584 has a unitary, single-piece construction, and can be composed of a metal material. In one example, a cross-sectional diameter of the pin 584 can be 1.6 mm; still, other diameter values are possible in other examples. With particular reference to FIG. 20, the pin 584 has a single prong 506 and a bridge 508 extending therefrom. The prong 506 is uni-directional and geometrically straight along its extent. When put in place, the prong 506 is directed axially relative to the circular shape of the VCT phaser 10. The bridge 508 is loop-shaped and presents a ring for an installer to put the pin 584 in place and remove it by hand. For receiving insertion of the pin's prong 506, the first carrier plate 48 has a first opening 510 residing in its structure and the second carrier plate 50 has a second opening 512 residing in its structure. The first and second openings 510, 512 complement the circular shape of the prong 506, and span wholly through the respective first and second carrier plate 48, 50 in the axial direction. With particular reference to the sectional view of FIG. 21, when the pin 584 is put in place in the VCT phaser 10, the pin's prong 506 goes through the first and second openings 510, 512. For receiving insertion of a proximal section of the prong 506, the housing assembly 26 has a third opening 516 residing in its structure. In particular, the third opening 516 resides in the outer retaining plate 43, which is connected to the wall 42 via roll-forming or some other technique. A projection 154 of the outer retaining plate 43 defines the third opening 516. The projection 154 extends radially-inboard of a usual inner circumference of the outer retaining plate 43 in order to bring the third opening 516 in alignment with the first and second openings 510, 512. The third opening 516 complements the circular shape of the prong 506, and spans wholly through the projection 154 in the axial direction. When the pin 584 is put in place in the VCT phaser 10, the proximal section of the pin's prong 506 goes through the third opening 516. Due to the position of the prong 506, the pin 584 fixes rotational movement of the housing assembly 26 to the first and second carrier plate 48, 50.

A ninth embodiment of the fixture 82 is presented in FIGS. 1 and 2. In FIG. 1, the fixture 82 is depicted exploded and removed from the VCT phaser 10; in FIG. 2, the fixture 82 is shown put in place. In this embodiment the fixture 82 ties together the housing assembly 26 and the sun gear 30. Because of the fixation, the fixture 82 constrains rotational movement of the first and second ring gears 44, 70, planet gears 54, and sun gear 30, thereby constraining relative rotational movement between the housing assembly 26 and inner plate 32. The fixture 82 here is in the form of a body 612. The body 612 has a unitary, single-piece construction, and can be composed of a plastic material. The body 612 has a disc shape that complements the size and shape of the wall 42. A pair of axial extensions 156 (only one depicted in FIGS. 1 and 2) extend from an aperture 158 in an axial direction relative to the disc shape; still, in other embodiments a single axial extension could be provided. The aperture 158 resides at a central region of the body 612 and has a size and shape that complement those of the sun gear 30. The axial extensions 156 are located opposite each other at the aperture 158. Furthermore, a cylindrical wall 160 extends from a main portion of the body 612 in an axial direction relative to the disc shape. The cylindrical wall 160 is slotted and discontinuous around an outer circumference of the body 612, but need not be in other embodiments. The inner circumference and outer diameter of the cylindrical wall 160 is slightly smaller than those of the wall 42 in order to effect a surface-to-surface press-fit between the two when the fixture 82 is put in place.

The sun gear 30 is slotted at its cylindrical wall 62 for interconnection with the electric motor 58. A first slot 162 resides on one side of the cylindrical wall 62, and a second slot 164 resides on an opposite side of the cylindrical wall 62. The first and second slots 162, 164 are accessible via an upper open end of the sun gear 30, and are features designed into the sun gear 30 for receipt of rotational drive from the electric motor 58. A single axial extension 156 complements the first slot 162 in terms of size and shape, and the other axial extension 156 likewise complements the second slot 164 in terms of size and shape. When the body 612 is put in place in the VCT phaser 10, one axial extension 156 is inserted and received in the first slot 162, and the other axial extension 156 is inserted and received in the second slot 164. Further, when the body 612 is put in place, the cylindrical wall 160 and wall 42 directly engage each other and make surface-to-surface press-fit abutment therebetween. Due to the receptions and insertions among the axial extensions 156 and first and second slots 162, 164, and the press-fit between the walls 160, 42, the body 612 fixes rotational movement of the sun gear 30 to the housing assembly 26.

In yet another embodiment that lacks specific depiction in the figures, the fixture 82 could tie together one of the planet gears 54 with another of the planet gears 54. The fixture 82 would hence constrain rotational movement of the first and second ring gears 44, 70, planet gears 54, and sun gear 30, thereby constraining relative rotational movement between the housing assembly 26 and inner plate 32. The fixture 82 could be in the form of a pin with a pair of prongs. When put in place, a first of the pair of prongs could go through an opening in the first carrier plate 48, while a second of the pair of prongs could go through another opening in the first carrier plate 48. The first of the pair of prongs could get situated and sandwiched between a pair of individual and neighboring teeth 56 of one of the planet gears 54, while the second of the pair of prongs could likewise get situated and sandwiched between a pair of individual and neighboring teeth 56 of another of the planet gears 54.

In the embodiments set forth, the load path established by the fixture and the components of the gear set assembly that are tied together facilitates the bearing of torque loads exerted amid installation and when a center bolt is tightened down. The gear ratio of the tied and constrained components results in a reduced torque load exerted that can more readily be withstood by the gear set assembly. For instance, in an example with the planetary gear set 24, the carrier assembly 28 can exhibit a 25:1 gear ratio in the gear set (i.e., 25 degrees of rotational movement of the carrier assembly 28 equates to 1 degree of rotational movement differentiation between the first and second ring gears 44, 70), effecting a corresponding reduction in torque load at the fixture 82 when the fixture 82 ties together the carrier assembly 28 and housing assembly 26 such as in the first embodiment. The torque load would be comparatively increased, for instance, if the fixture 82 tied and constrained the first and second ring gears 44, 70 directly and immediately together, where the gear ratio exhibited could be 1:1.

Moreover, the embodiments set forth help maintain the angular positioning between the input and output gears and improves the precision in which it is accomplished. A tighter tolerance can be maintained on the angle between the input and output gears as a result of the gear ratio among the components being tied together by the fixture. In an example like those presented in the figures, a similar clearance is held at the fixture and the components tied together. The ring gears have a 1:1 gear ratio, while the carrier assembly has a 25:1 gear ratio relative to the ring gears (i.e., 25 degrees of rotational movement of the carrier assembly equates to 1 degree of rotational movement differentiation between the ring gears). A small degree of movement can occur at the fixture. Two degrees of rotational movement at the fixture, for instance, would result in a mere two degrees divided by twenty-five degrees (2°/25°) of rotational movement between the ring gears. Contrast that relatively reduced amount of movement with a two-degree rotational movement between the ring gears that would occur if the ring gears were themselves tied directly and immediately to each other.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. An electrically-actuated variable camshaft timing (VCT) phaser, comprising:

a gear set assembly having an input gear that receives rotational drive input from an engine crankshaft, and having an output gear that transmits rotational drive output to an engine camshaft; and a fixture removably secured in the gear set assembly so as to constrain rotational movement of the gear set assembly amid installation of the electrically-actuated VCT phaser on an internal combustion engine, the fixture lacking direct securement between the input gear and the output gear, wherein the fixture counteracts a biasing force exerted by a backlash spring disposed in a housing assembly of the gear set assembly.

2. The electrically-actuated variable camshaft timing (VCT) phaser as set forth in claim 1, wherein the fixture has direct removable securement with a plate of the gear set assembly.

3. The electrically-actuated variable camshaft timing (VCT) phaser as set forth in claim 1, wherein the fixture has direct removable securement with an intermediate gear of the gear set assembly, the intermediate gear situated in a path of rotational transmission between the input gear and the output gear.

4. The electrically-actuated variable camshaft timing (VCT) phaser as set forth in claim 1, wherein the gear set assembly is a planetary gear set.

5. An electrically-actuated variable camshaft timing (VCT) phaser, comprising:

a gear set assembly having an input gear that receives rotational drive input from an engine crankshaft, and having an output gear that transmits rotational drive output to an engine camshaft;

a fixture removably secured in the gear set assembly so as to constrain rotational movement of the gear set assembly amid installation of the electrically-actuated VCT phaser on an internal combustion engine, the fixture lacking direct securement between the input gear and the output gear;

wherein the gear set assembly is a planetary gear set including a carrier plate and a sun gear, the carrier plate having an opening; and wherein the fixture is removably received in the opening and is removably situated between a pair of adjacent teeth of the sun gear.

6. An electrically-actuated variable camshaft timing (VCT) phaser, comprising:

a gear set assembly having an input gear that receives rotational drive input from an engine crankshaft, and having an output gear that transmits rotational drive output to an engine camshaft;

a fixture removably secured in the gear set assembly so as to constrain rotational movement of the gear set assembly amid installation of the electrically-actuated VCT phaser on an internal combustion engine, the fixture lacking direct securement between the input gear and the output gear;

wherein the gear set assembly is a planetary gear set including a carrier plate and a sun gear, the carrier plate having an opening and the sun gear having a slot; and wherein the fixture has a first extension and a second extension, the first extension removably received in the opening, and the second extension removably received in the slot.

7. An electrically-actuated variable camshaft timing (VCT) phaser, comprising:

a gear set assembly having an input gear that receives rotational drive input from an engine crankshaft, and having an output gear that transmits rotational drive output to an engine camshaft;

a fixture removably secured in the gear set assembly so as to constrain rotational movement of the gear set assembly amid installation of the electrically-actuated VCT phaser on an internal combustion engine, the fixture lacking direct securement between the input gear and the output gear;

wherein the gear set assembly is a planetary gear set including a carrier plate and a sun gear, the carrier plate having at least one recess and the sun gear having a slot; and wherein the fixture has at least one lobe and an extension, the at least one lobe removably received in the at least one recess, and the extension removably received in the slot.

8. An electrically-actuated variable camshaft timing (VCT) phaser, comprising:

a gear set assembly having an input gear that receives rotational drive input from an engine crankshaft, and having an output gear that transmits rotational drive output to an engine camshaft;

a fixture removably secured in the gear set assembly so as to constrain rotational movement of the gear set assembly amid installation of the electrically-actuated VCT phaser on an internal combustion engine, the fixture lacking direct securement between the input gear and the output gear;

wherein the gear set assembly is a planetary gear set including a carrier plate and a plurality of planet gears carried by the carrier plate, the carrier plate having an opening; and wherein the fixture is a pin, the pin removably received in the opening and removably situated between a pair of adjacent teeth of one of the plurality of planet gears.

9. An electrically-actuated variable camshaft timing (VCT) phaser, comprising:

a gear set assembly having an input gear that receives rotational drive input from an engine crankshaft, and having an output gear that transmits rotational drive output to an engine camshaft;

a fixture removably secured in the gear set assembly so as to constrain rotational movement of the gear set assembly amid installation of the electrically-actuated VCT phaser on an internal combustion engine, the fixture lacking direct securement between the input gear and the output gear;

wherein the gear set assembly is a planetary gear set including a carrier plate and an inner plate, the carrier plate having a first opening and the inner plate having a second opening; and wherein the fixture is removably received in the first opening and in the second opening.

10. An electrically-actuated variable camshaft timing (VCT) phaser, comprising:

a gear set assembly having an input gear that receives rotational drive input from an engine crankshaft, and having an output gear that transmits rotational drive output to an engine camshaft;

a fixture removably secured in the gear set assembly so as to constrain rotational movement of the gear set assembly amid installation of the electrically-actuated VCT phaser on an internal combustion engine, the fixture lacking direct securement between the input gear and the output gear;

wherein the gear set assembly is a planetary gear set including an outer retaining plate and a carrier plate, the outer retaining plate having a first opening and the carrier plate having a second opening; and wherein the fixture is a pin, the pin removably received in the first opening and in the second opening.

11. An electrically-actuated variable camshaft timing (VCT) phaser, comprising:

a gear set assembly having an input gear that receives rotational drive input from an engine crankshaft, and having an output gear that transmits rotational drive output to an engine camshaft;

a fixture removably secured in the gear set assembly so as to constrain rotational movement of the gear set assembly amid installation of the electrically-actuated VCT phaser on an internal combustion engine, the fixture lacking direct securement between the input gear and the output gear;

wherein the gear set assembly is a planetary gear set including a sun gear and a housing assembly, the sun gear having a slot; and wherein the fixture has an extension, the extension removably received in the slot, and the fixture is press-fit over the housing assembly.

12. An electrically-actuated variable camshaft timing (VCT) phaser, comprising:

a planetary gear set including a carrier plate and a housing assembly, the carrier plate having a first opening and the housing assembly having a second opening; and a pin removably received in the first opening and in the second opening so as to constrain rotational movement of the planetary gear set.

13. The electrically-actuated variable camshaft timing (VCT) phaser as set forth in claim 12, wherein the pin counteracts a biasing force exerted by a backlash spring disposed in the housing assembly.

14. The electrically-actuated variable camshaft timing (VCT) phaser as set forth in claim 13, wherein the pin includes a first prong and a second prong received in the first opening and in the second opening, respectively.

* * * * *